US009105175B1

(12) United States Patent
Cantolino et al.

(10) Patent No.: US 9,105,175 B1
(45) Date of Patent: Aug. 11, 2015

(54) WATER HEATER ALARM

(71) Applicants: Christopher R. Cantolino, Bradenton, FL (US); Steven V. Leone, Lake Worth, FL (US)

(72) Inventors: Christopher R. Cantolino, Bradenton, FL (US); Steven V. Leone, Lake Worth, FL (US)

( * ) Notice: Subject to any disclaimer, the term of this patent is extended or adjusted under 35 U.S.C. 154(b) by 0 days.

(21) Appl. No.: 14/273,524

(22) Filed: May 8, 2014

(51) Int. Cl.
*G08B 21/00* (2006.01)
*G08B 21/20* (2006.01)
*F24H 9/00* (2006.01)

(52) U.S. Cl.
CPC *G08B 21/20* (2013.01); *F24H 9/00* (2013.01); *Y10T 137/7306* (2015.04)

(58) Field of Classification Search
CPC ... G08B 21/20; F24H 9/165; Y10T 137/7306; Y10T 137/5762; Y10T 137/8342
USPC ..... 340/605, 604; 137/312; 122/504
See application file for complete search history.

(56) References Cited

U.S. PATENT DOCUMENTS 5,188,143 A * 2/1993 Krebs ..... 137/312
5,315,291 A * 5/1994 Furr ..... 340/605
5,345,224 A * 9/1994 Brown ..... 340/605
6,024,116 A * 2/2000 Almberg et al. ..... 137/312
6,025,788 A * 2/2000 Diduck ..... 340/605
6,157,307 A * 12/2000 Hardin ..... 340/605
6,276,309 B1 * 8/2001 Zeek ..... 340/605
7,424,896 B1 * 9/2008 Martin et al. ..... 137/312
7,489,253 B2 * 2/2009 Murphy ..... 340/605
7,671,754 B2 * 3/2010 Heilmann et al. ..... 340/605
8,061,380 B1 * 11/2011 Martin et al. ..... 137/312
8,319,626 B1 * 11/2012 Cantolino ..... 137/312

* cited by examiner

*Primary Examiner* — John A Tweel, Jr.
(74) *Attorney, Agent, or Firm* — Dorothy S. Morse

(57) ABSTRACT

A water sensor and alarm system for storage water heaters comprising an alarm housing, embedded battery, annunciator, and two bottom exposed fluid sensors separated by a stand-off. The system is designed for prompt owner notification when fluid is detected adjacent to a hot water heater tank. Notification is audible, and optionally may be in the form of remote notification, such as but not limited to a signal transmitted to the home security device connected to a 24-hour security monitoring network, or a smart phone, tablet, or other smart device. The alarm housing can be easily and quickly mounted to the side of the water heater tank. Ultra low power consumption is an important benefit provided by the alarm system, which continues during low battery warnings and water detection alarming. Also, the audible alarm may optionally include a boost circuit to amplify annunciator loudness, but at a tradeoff with conserving power.

20 Claims, 19 Drawing Sheets

WATER HEATER ALARM

CROSS-REFERENCES TO RELATED APPLICATIONS

None.

BACKGROUND

1. Field of the Invention

This invention relates to alarms used for fluid leakage notification, specifically to a simple water sensor and alarm system for storage hot water heaters comprising an alarm housing, embedded battery, annunciator, and two bottom exposed fluid sensors separated by a stand-off. Hereinafter, storage hot water heaters may be referred to only as 'water heater', 'water heaters', or "water heater tank", without any intent of limitation. The system is designed for prompt owner notification when fluid is detected adjacent to a water heater tank. Fluid leakage notification is audible, as many hot water heater tank failures occur in occupied homes. However, water leakage notification may optionally be in the form of remote communication, such as but not limited to a signal transmitted to the home security device of a 24-hour security monitoring network, or a smart phone, tablet, or other smart device. The alarm housing can be easily mounted to the side of the water heater tank, or may be configured as a stand-alone device. Ultra low power consumption is an important benefit provided by the present invention, which continues during low battery warnings and water detection alarming. Also, the audible alarm may optionally include a boost circuit to amplify annunciator loudness, but at a tradeoff with conserving power.

2. Description of the Related Art

Hot water heaters typically leak as they approach the end of their service life, or if premature failure occurs. If leaks remain undetected, tank failure can occur. The average age of a failed hot water heater tank is approximately 10.7 years. While tank failure causes significant damage to adjacent portions of a residence and/or property maintained in areas surrounding the hot water heater tank, even small leaks in the vicinity of the water heater tank, depending on the severity of the leak, may cost a homeowner several thousands of dollars of repair or replacement expense. Furthermore, in residential storage hot water heating systems approximately 90% of hot water heater failures occur in occupied homes, with about 70% of failures resulting from small repairable leaks. Another disadvantage of small leaks in storage hot water is that billions of gallons of water are potentially lost annually when they remain undetected. Another contributing factor to premature hot water heater tank failure is that hot water heating systems generally work for many years before a problem develops. Additionally, after-installation owner maintenance is minimal, and checking hot water heater storage tanks frequently for leaks is not a common practice of their owners. If such leaks do occur and are not promptly detected, leaking water will accelerate the growth of mold on and around the hot water heater tank, as well as accelerate tank corrosion that will reduce its useful life and also increase the risk of catastrophic tank failure where many gallons of water will be lost if the water flowing into it is not promptly shut off. Thus, there is a need for a device or system to monitor storage hot water tanks for leaks and promptly provide owner notification as soon as possible after leaks begin to divert water from the tank, and it is also preferred for such a device to provide a persistent alarm or remote notification that occurs over an extended period of time to increase the likelihood of owner response. The present invention system is a compact and portable sensing device that is able to promptly detect small hot water heater tank leaks and alert the property owner of their presence to limit or prevent property damage in the area adjacent to the hot water heater tank, providing an important benefit. Ultra low power consumption is also an important benefit provided by the present invention, including during low battery warnings and water detection alarming, extending the time during which annunciation occurs and increasing the likelihood of successful owner notification about the presence of fluid leakage. No other system is known that has the same structure as the present invention, functions in the same manner as the present invention, and/or provides all of the features and advantages of the present invention.

BRIEF SUMMARY OF THE INVENTION

The primary object of this invention is to provide a water sensor and alarm system for use with storage hot water heaters that provides prompt detection of fluid leaks and prompt notification thereof to its owner, reducing the water loss from undetected leaks, reducing water heater tank corrosion that could reduce its useful life, and also reducing the probability of catastrophic hot water heater tank failure and the potential for significant damage in the vicinity of the hot water heater to the residence and/or property. A further object of this invention is to provide an automated water sensor and alarm system for storage hot water heaters with ultra low power consumption that extends the time during which annunciation of low battery warnings and fluid detection alarming occurs, increasing the likelihood of successful owner notification. Another object of this invention is to provide an automated water sensor and alarm system with an optional boost circuit to amplify annunciator loudness during low battery warning and fluid detection alarming signals. It is also an object of this invention to provide an alarm system for storage hot water heaters having both residential and commercial applications. It is a further object of this invention to provide an automated alarm system that is easily installed, easily tested at any time after installation for proper operation, and after installation requires no inspection, maintenance, or other action by its user until a low battery warning or fluid detection alarming occurs. It is also an object of this invention to provide an automated alarm system with the option of remote owner notification. Another object of this invention is to provide an automated alarm system having a useful life that meets or exceeds that of the hot water heater with which it is associated. It is also an object of this invention to provide an automated alarm system that is compact and unobtrusively located so as to not interfere significantly with its surroundings.

The present invention, when properly made and used, will provide a water sensor and alarm system for storage hot water heaters comprising a compact alarm housing, embedded battery, annunciator, and two simple bottom-exposed fluid sensors separated by a stand-off. The alarm system is easily attached unobtrusively to the outside surface of a storage hot water heater tank where it will not interfere significantly with its surroundings, preferably via use of double-sided adhesive or an adhesive-backed hook-and-loop fastener, but not limited thereto. When its standoff is placed in contact with the surface supporting the water heater tank, water detection at a very low fluid depth is allowed by the two bottom-exposed fluid sensors adjacent to the standoff, increasing the likelihood of prompt owner notification before catastrophic tank failure and significant damage to the residence and property can occur. Installation with fluid sensors at higher elevations is also possible, according to installation site requirements or owner preference. After installation the present invention alarm system requires no inspection, maintenance, or other action by its user until a low battery warning or fluid detection alarming occurs. Notification is preferably audible, and optionally may be in the form of remote notification, such as but not limited to a signal transmitted to the home security device of a 24-hour security monitoring network, or a smart phone, tablet, or other smart device. Ultra low power consumption is an important benefit provided by the present invention and continues during low battery warnings and water detection alarming, which is achieved via a sleep loop and sequential changes to the frequency of annunciator signal production according to the amount of remaining battery power and/or the duration of warning/alarming. This will allow a standard 9-volt to operate the present invention alarm system unattended for approximately five years, and if needed provide a low battery warning for at least sixty days, and low battery alarming for more than five days. When other types of batteries are used, such as but not limited to a 9-volt lithium battery, battery life, low battery warning time, and low battery alarming time may be increased, even doubled. When the audible alarm includes an optional boost circuit, the loudness of the annunciator can be amplified, but at a tradeoff with conserving power. Reset of present invention circuitry after signal generation occurs is not required, and alternatively test operation of the annunciator for confidence of its proper function can be easily accomplished at any time by a user simultaneously touching both of the bottom exposed fluid sensors with wet fingers. Although initially contemplated primarily for residential use, commercial applications are also considered within the scope of the present invention alarm system.

The description herein provides preferred embodiments of the present invention but should not be construed as limiting its scope. For example, variations in the size and configuration of the alarm housing; the configuration of the cap; the means of attachment between alarm housing and cap, the size and shape of the front audible alarm opening in the alarm housing; the configuration of interior alarm housing features used to support and/or protect the annunciator and circuitry relating to its operation; other than those shown and described herein, may be incorporated into the present invention. Thus the scope of the present invention should be determined by the appended claims and their legal equivalents, rather than being limited to the examples given.

COMPONENT LIST

Figure 1:
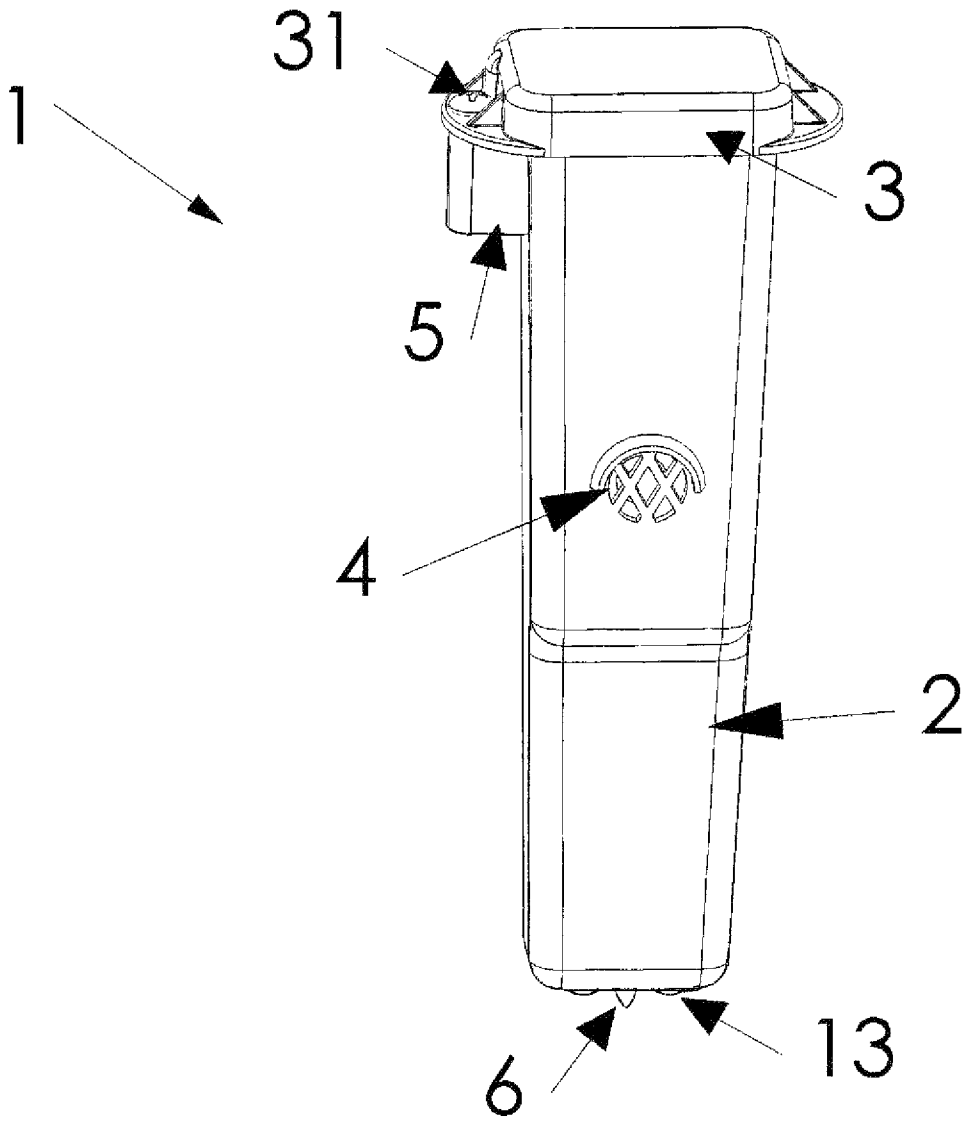
FIG. 1 is a perspective view from the front of the hot water heater alarm in the most preferred embodiment of the present invention, and showing a cap secured to the top of an alarm housing with a front audible alarm opening and a bottom standoff.

1—water sensor and alarm system
2—alarm housing
3—cap
4—audible alarm opening
5—cap mount
6—bottom standoff
7—cap mount opening
8—small projection on front or back of alarm housing 2 near its top edge
9—large projection on the side of alarm housing 2 remote from cap mount 5
10—top open end of alarm housing 2
11—loop portion of a hook-and-loop fastener
12—hook portion of a hook-and-loop fastener
13—fluid/water sensor (one end is exposed through a bottom hole 14 in alarm housing 2)
14—hole through bottom end of alarm housing 2 for exposure of the tip of a sensor 13
15—paired slots within alarm housing 2
16—cap flange
17—strengthening wedge
18—hole through cap flange 16 used to connect cap 3 and alarm housing 2 with fastener 31
19—rectangular hole through the end of cap 3 positioned remote from the flange 16 having hole
18 and used to receive projection 9 near the top edge of alarm housing 2
20—indentation on the interior surface of cap 3 used to receive a small projection 8 near the top edge of alarm housing 2
21—(Number Not Used)
22—preferred internal components of water sensor and alarm system 1, including microcontroller and control circuits that are 'in circuit' programmable (printed circuit board 28) and power supply (battery 23)
23—battery
24—electrical connector
25—electrical wiring
26—wiring strain relief
27—annunciator with optional boost circuit to a buzzer or other device producing an audible signal
28—printed circuit board
29—optional relay (for remote notification)
30—contact/mount for sensor 13
31—fastener
32—storage hot water heater tank

DETAILED DESCRIPTION OF THE INVENTION

The present invention provides a simple water sensor and alarm system 1 for storage hot water heaters comprising an alarm housing 2, embedded battery 23, annunciator 27, and two bottom exposed fluid sensors 13 separated by a stand-off 6. The present invention is designed for prompt owner notification when water/fluid (not shown) is detected adjacent to a water heater tank 32. Preferred notification is audible, and audible sounds only occur when water leakage is detected by sensors 13 or battery power for annunciator 27 is low. Optionally owner notification may be in the form of remote communication, such as but not limited to wireless communication transmitted to a home security device of a 24-hour security monitoring network (not shown), or to a smart phone, tablet, or other smart device. The alarm housing 2 can be easily mounted to the side of the water heater tank 32 via adhesive or adhesive-backed connecting means, such as but not limited to adhesive-backed hook-and-loop types of fasteners (11, 12). However, although not shown in the accompanying illustrations, it is also contemplated for alarm housing 2 to have a stand-alone configuration. Ultra low power consumption is an important benefit provided by the present invention alarm system 1, which continues during low battery warnings and water detection alarming, and is achieved via a sleep loop and sequential changes to the frequency of annunciator signal production according to the amount of remaining battery power and/or the amount of elapsed time since the start of the warning or alarming signal. Also, the annunciator 27 may optionally include a boost circuit to amplify its loudness up to as much as 100 decibels, such as by doubling the voltage to the buzzer portion only of annunciator 27 from approximately 8-volts to approximately 16-volts. However, this boost in loudness would occur at a tradeoff with power conservation. When water (not shown) first contacts fluid/water sensors 13, an electrical circuit is completed that causes the annunciator 27 to produce an audible signal. No reset of circuitry is required for continued use after warning or alarming occurs. FIGS. 1-10 show the alarm housing 2 and the most preferred features and components associated with it, while FIGS. 11-21 include flow charts, diagrams, graphs, and other information relating to the programming and operation of water sensor and alarm system 1.

Figure 2:
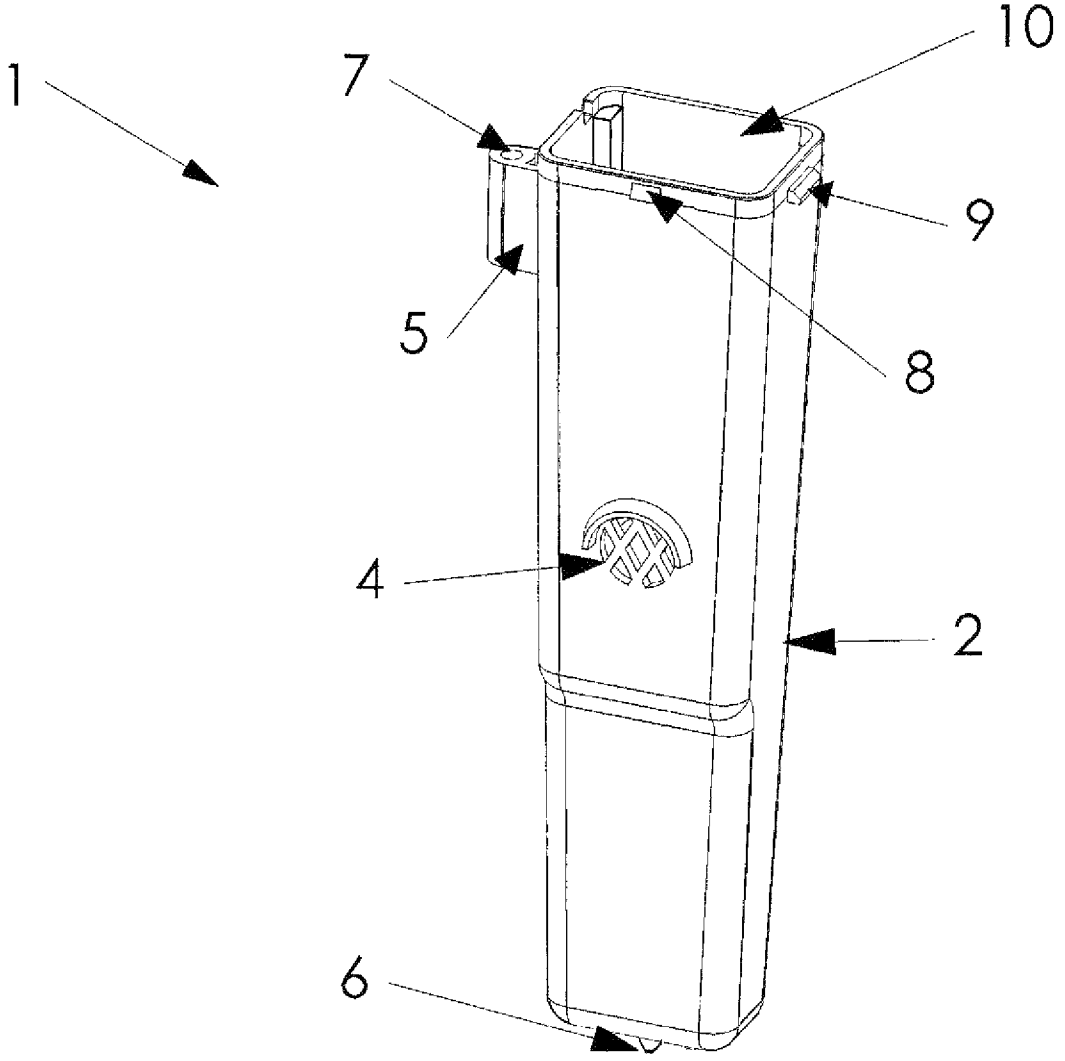
FIG. 2 is a perspective view from the front of the water heater alarm housing shown in FIG. 1 without the top cap, showing the cap mount on one side of the alarm housing used to fix the cap securely to the alarm housing, and also showing projections on the front and side of the alarm housing near its top edge that assist in providing a secure connection between the alarm housing and cap.

FIGS. 1-10 show alarm housing 2 and its most preferred features and components. FIG. 1 is a perspective view from the front of the hot water heater alarm 1 in the most preferred embodiment of the present invention. It shows a cap 3 positioned over and covering the top open end 10 (see FIG. 2) of an alarm housing 2, which has a centrally positioned front audible alarm opening 4 and a bottom standoff 6 separating two fluid sensors 13. The size, positioning, and configuration of front audible alarm opening 4 is not critical, and may be different from that shown in FIG. 1 as long as it fulfills its function of allowing the audible signal of annunciator 27 to provide the needed owner notification should water leakage from an associated storage hot water heater tank 32 (see FIG. 10) be detected by fluid sensors 13. The size and configuration of bottom standoff 6 is also not limited to that shown in FIG. 1, as long as it separates the two fluid sensors 13 extending through the bottom of alarm housing 2 to eliminate the generation of false warning and alarming signals. In addition, FIG. 1 shows a cap mount 5 depending outwardly from one side of alarm housing 2 near its top open end 10 (see FIG. 2) and a portion of one end of cap 3 extending over cap mount 5. FIG. 1 further shows the head of a fastener 31 positioned above one end of cap 3 can be used for providing a secure connection between alarm housing 2 and cap 3 to avoid inadvertent removal of cap 3 (by the owner or others) during its use that might lead to accidental (and preventable) malfunction of hot water heater alarm 1. Although promoting a goal of simplicity and reduced material expense in the most preferred embodiment of the present invention, the size, configuration, positioning of the singular cap mount 5 shown in FIG. 1 is preferred, but not critical. FIG. 2 is a perspective view from the front of the alarm housing 2 shown in FIG. 1 without cap 3, and revealing the top open end 10 of alarm housing 2. FIG. 2 also shows a small front projection 8 and a large side projection 9 on alarm housing 2 near its top open end 10 that assist in providing a secure connection between alarm housing 2 and cap 3. The size, number, configuration, and positioning of projections 8 and 9 are not critical, and may be different from that shown as long as they fulfill their intended functions of securing cap 3 to alarm housing 2. Large side projection 9 is preferred only on the side of alarm housing 2 remote from cap mount 5, and when only one is provided it is preferred for it to be in a position opposed from cap mount 5. FIG. 2 also shows a cap mount opening 7 that is used with the hole 18 through cap 3 to receive a fastener 31 (see FIG. 9). In addition, FIG. 2 shows centrally-positioned front audible alarm opening 4 and the distal end of bottom standoff 6.

Figure 3:
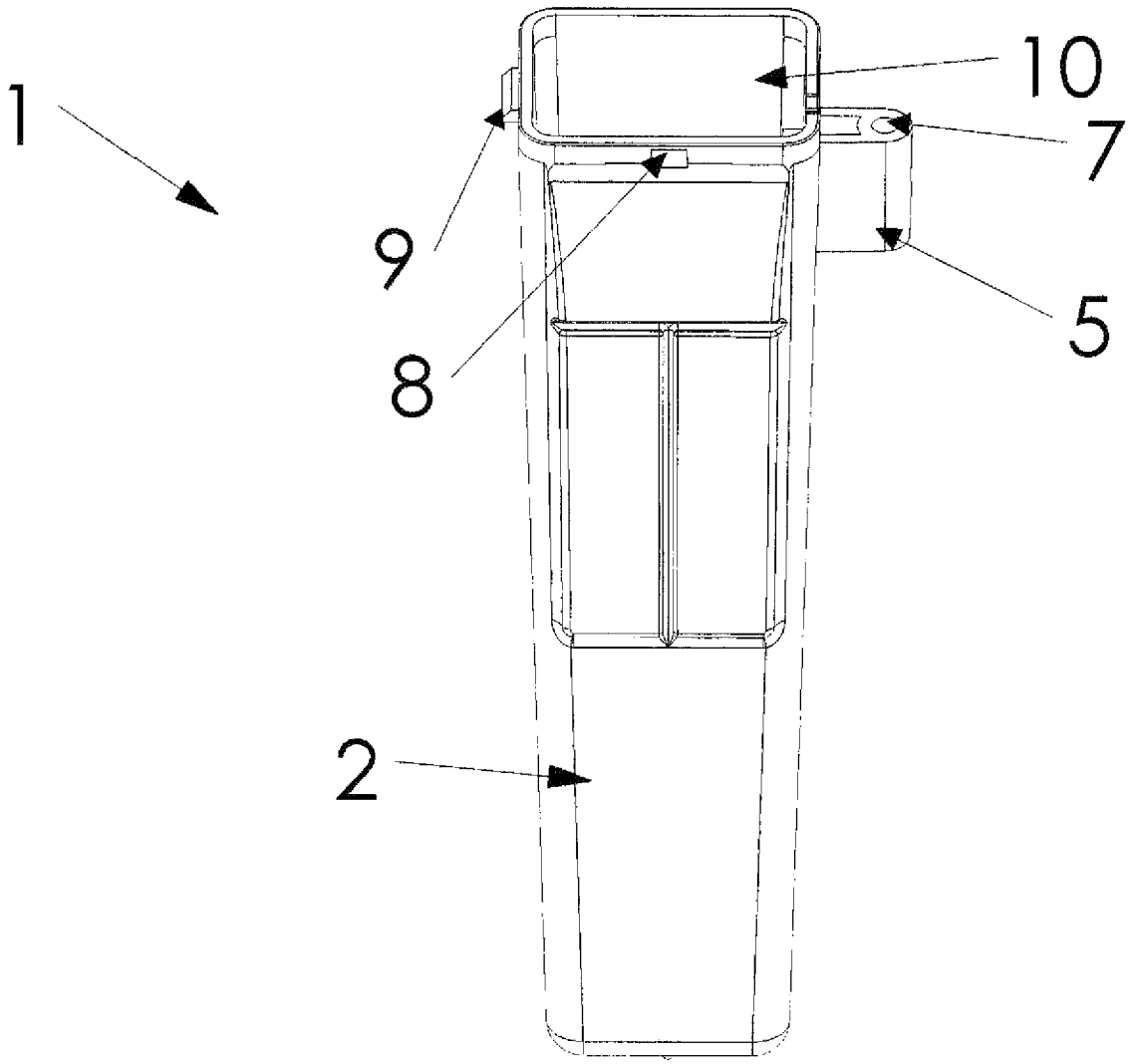
FIG. 3 is a perspective view from the back of the water heater alarm shown in FIG. 1 without the top cap, and also showing the cap mount on one side of the alarm housing used to fix the cap securely to the alarm housing, as well as the side projection and a rear projection that assist in providing a secure connection between the alarm housing and cap.
Figure 4:
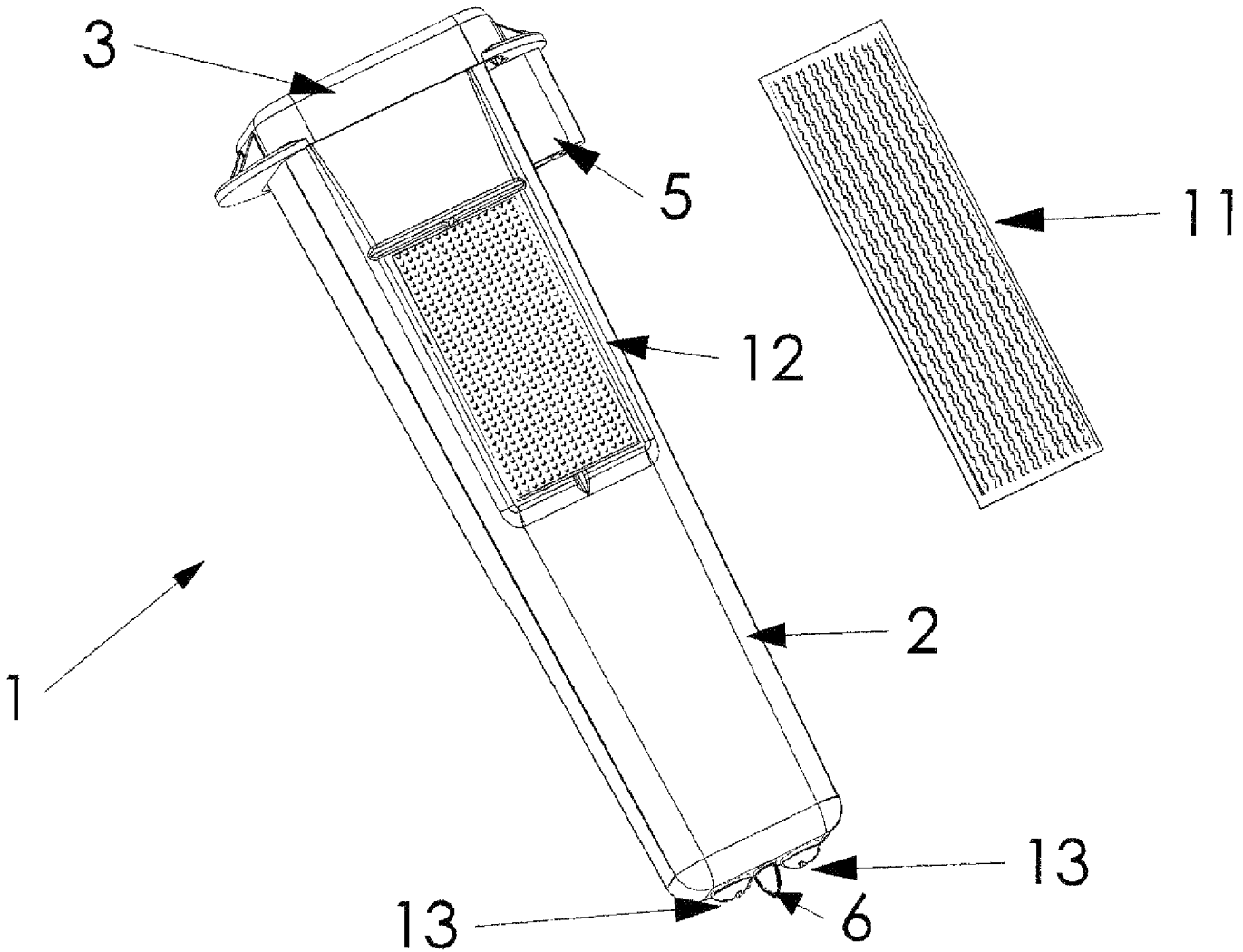
FIG. 4 is a perspective view from the back of the water heater alarm shown in FIG. 1 with the top cap so that the front, rear, and side projections are covered, and further showing hook-and-loop fasteners that can be used to attach the alarm to a water heater tank.

FIGS. 3 and 4 are both perspective views from the back of the water heater alarm 1 shown in FIG. 1. FIG. 3 shows alarm housing 2 without cap 3, while FIG. 4 shows cap 3 connected over the top open end 10 of alarm housing 2. FIGS. 3 and 4 both also shows the cap mount 5 on one side of alarm housing 2, with FIG. 3 further showing cap mount opening 7 and the projections 8 and 9 respectively on the back and side exterior surfaces of alarm housing 2 near its top open end 10. In addition FIG. 4 shows the two fluid sensors 13 exposed through the bottom end of alarm housing 2 and separated by standoff 6 that prevents the generation of false warning and alarm signals. FIG. 4 further shows hook-and-loop fasteners 12 and 11 that can be used to attach the back exterior surface of alarm housing 2 to a water heater tank 32 (see FIG. 10). As shown in FIG. 4, the hook portion 12 is smaller and preferably adhesive-backed, and secured to the back exterior surface of alarm housing 2. In contrast, the loop portion 11 is slightly longer than hook portion 12, providing easier installation of alarm housing 2 since an exact pairing of hook portion 12 to loop portion 11 is not required, instead allowing a full complement of hook portion 12 attachment to loop portion 11 with some vertical adjustment permitted to place standoff 6 as close as possible to the surface (not shown) supporting storage hot water heater tank 32 for prompt annunciator 27 signal production when only a small amount of water leakage onto the surface is present adjacent to water heater tank 32. The use of hook portion 12 on the exterior surface of alarm housing 2 is not critical, and the reverse is also considered to be within the scope of the present invention wherein the loop portion 11 is attached to the exterior surface of alarm housing 2 and the hook portion 12 is secured to water heater tank 32. Also although the size, configuration, number of pieces used, and positioning of hook portion 12 and loop portion 11 are not critical, and may be different from that shown as long as they fulfill their intended functions, heavy duty hook portions 12 and loop portions 11 are preferred.

Figure 5:
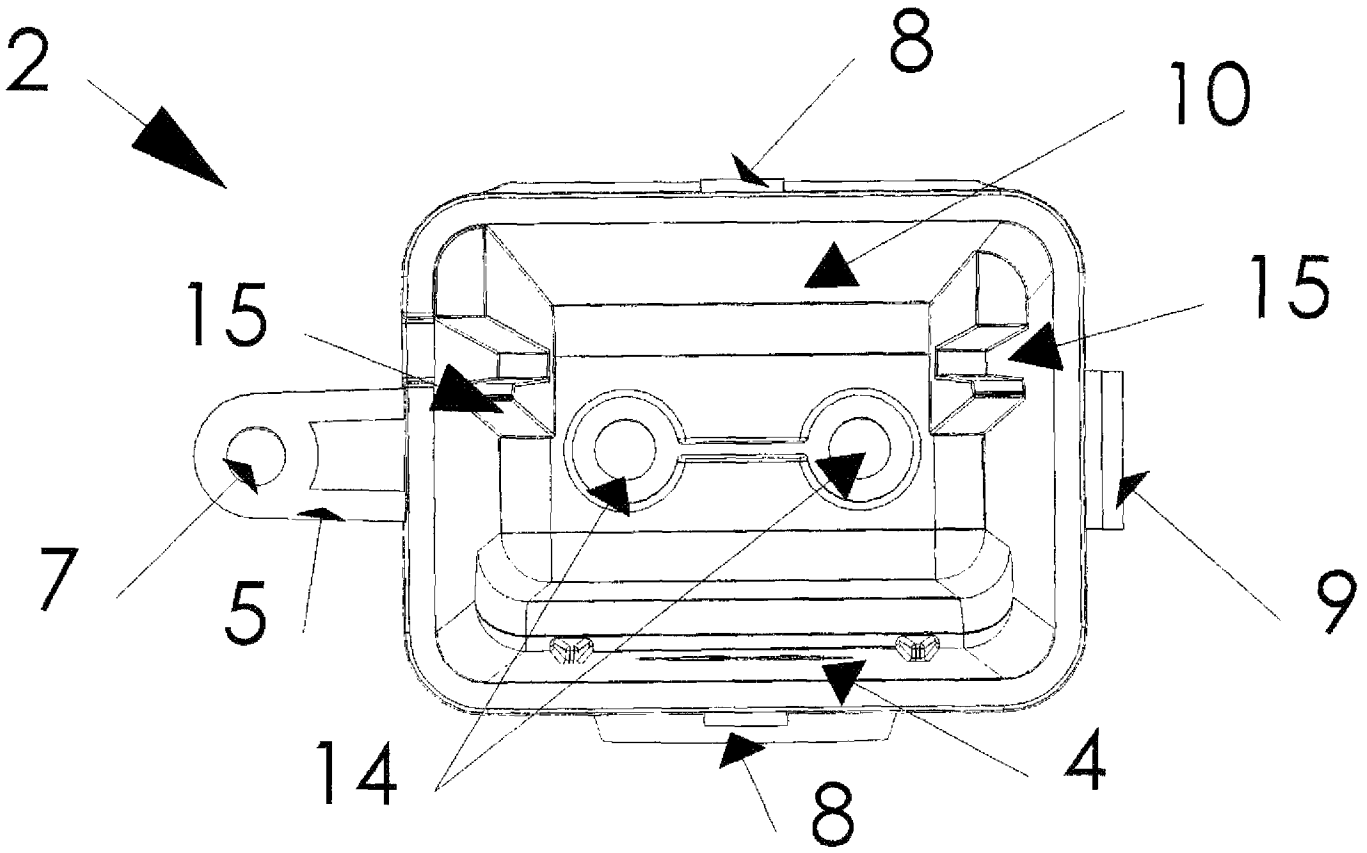
FIG. 5 is a top view of the interior of the alarm housing in the water heater alarm shown in FIG. 1, and showing its bottom openings for bottom exposure of the two water sensors, an opening through the cap mount that is used for a fastener connection between the cap and alarm housing, and paired slots that assist in proper positioning of internal alarm components.

FIG. 5 is a top view of the interior of the most preferred embodiment of alarm housing 2 as seen through is open top end 10. FIG. 5 shows bottom openings 14 through which the distal ends of two water sensors 13 are exposed (see FIG. 9) for their usable positioning on opposite sides of standoff 6. FIG. 5 also shows the opening 7 through cap mount 5 that is used for a fastener 31 connection (see FIG. 9) of cap 3 to alarm housing 2. In addition, FIG. 5 shows paired slots 15 that assist in proper positioning of internal alarm components 22 (see FIGS. 8 and 9). Furthermore, FIG. 5 shows the preferred positioning of front audible opening 4, the small front and back projections 8, and large side projection 9 used to help secure cap 3 to alarm housing 2.

Figure 6:
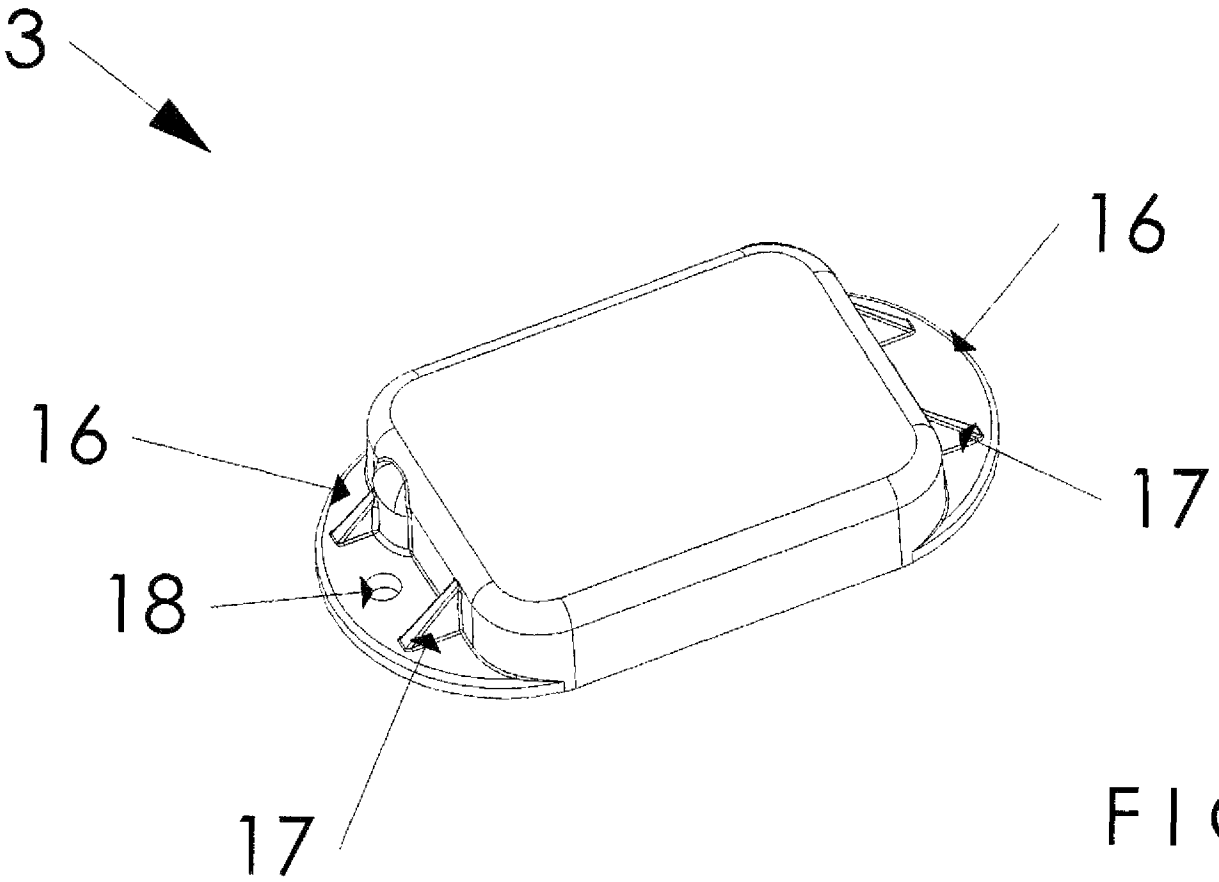
FIG. 6 is a perspective view from the top of the cap preferred for use with the water heater alarm shown in FIG. 1, with opposed flanges each having top strengthening wedges, and a hole through one flange used for a fastener connection between the cap and alarm housing.
Figure 7:
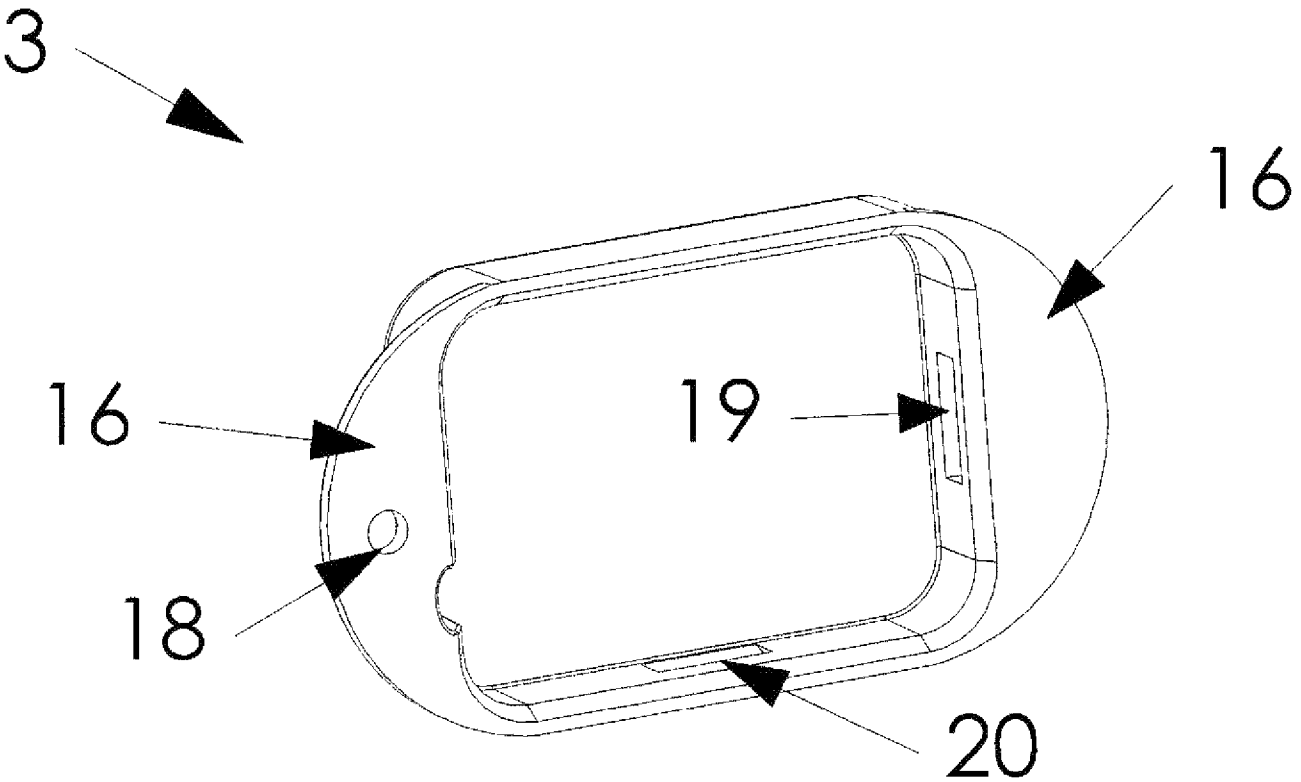
FIG. 7 is a perspective view from the bottom of the cap in FIG. 6, and showing an indentation and a rectangular hole therethrough that are used with two of the three projections near the exterior top edge of the alarm housing to help provide a secure connection between the cap and alarm housing.

FIGS. 6 and 7 respectively are perspective views from the top and bottom of the cap 3 which is preferred for use with the water heater alarm housing 2 shown in FIG. 1. FIGS. 6 and 7 both show cap 3 having opposed flanges 16, and FIG. 3 shows two strengthening wedges 17 connected to the top surface of cap 3 and extending between the large center portion of cap 3 and each flange 16. The size, number, configuration, and positioning of strengthening wedges 17 are not critical, and may be different from that shown as long as they fulfill their intended functions. FIGS. 6 and 7 both show a hole 18 through one flange 16 that can be used for a fastener 31 connection (see FIG. 9) between cap 3 and alarm housing 2. The size, configuration, and positioning of flanges 16 are also not critical, although the amount of material in the flange 16 positioned above cap mount 5 must be sufficiently large to provide a strong fastener 31 connection between cap 3 and alarm housing 2. In addition, FIG. 7 shows a rectangular hole 19 through the end of cap 3 positioned remote from the flange 16 having the hole 18, with rectangular hole 19 sized, positioned, and configured to receive projection 9 near the top open end 10 of alarm housing 2 on its side remote from cap mount 5. FIG. 7 further shows an indentation 20 on the interior back surface of cap 3 that is used to receive the small back projection 8 near the top open end 10 of alarm housing 2. Although not shown, from the positioning of the small projection 8 on the front surface of the alarm housing 2 in FIG. 2, and the lack of a hole or other opening on the front surface of cap 3 in FIG. 1, it can be inferred that the interior front surface of the cap 3 in the most preferred embodiment of the present invention alarm system 1 has a similar indentation 20 to that shown in FIG. 7.

Figure 8:
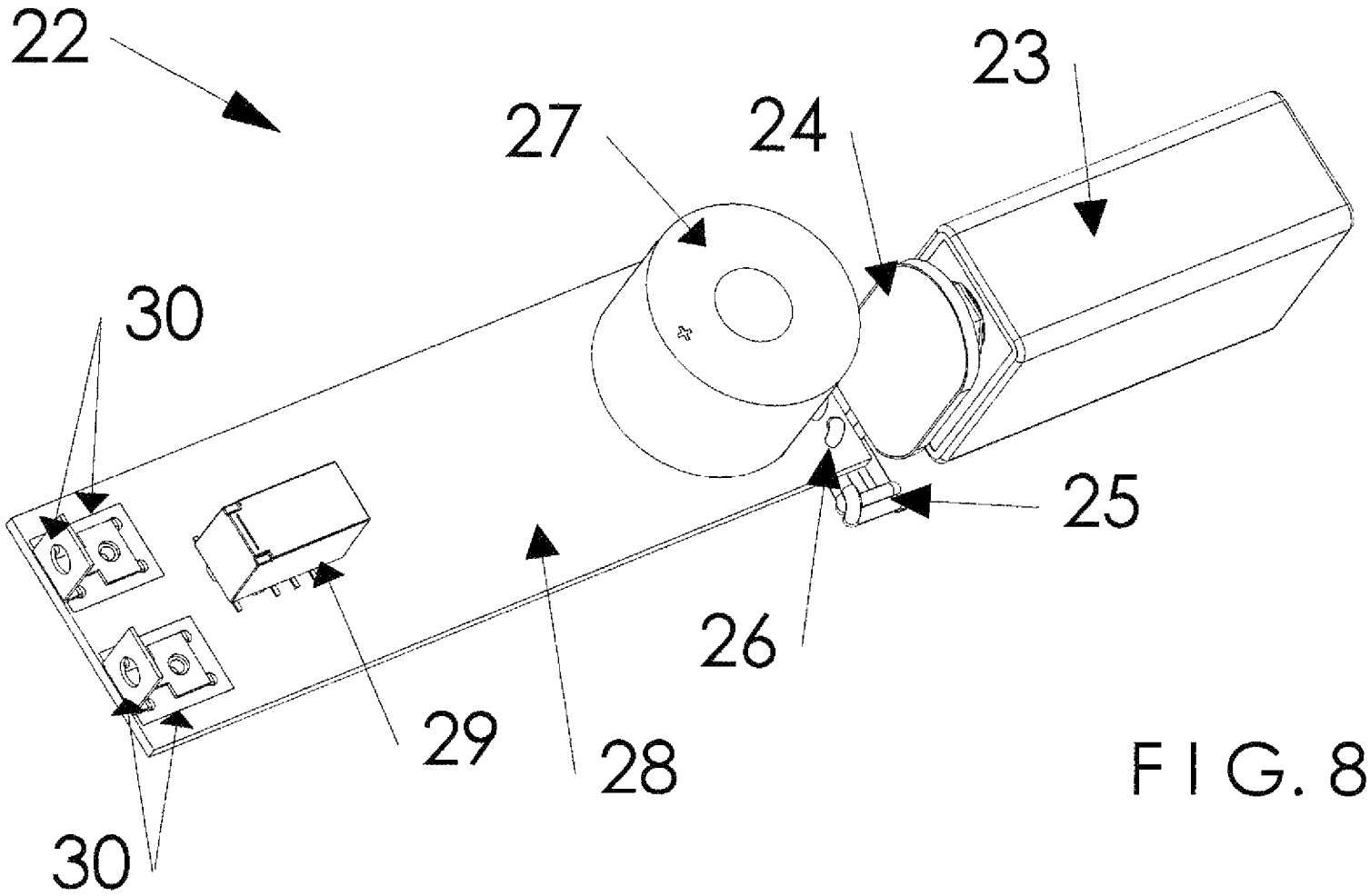
FIG. 8 is a perspective view of internal alarm components preferably used as a part of the water heater alarm shown in FIG. 1, and showing a battery connected to a circuit board having a mounted annunciator/buzzer, optional relay used for notification to an external home security system, wire strain relief, and two sensor contacts/mounts.
Figure 9:
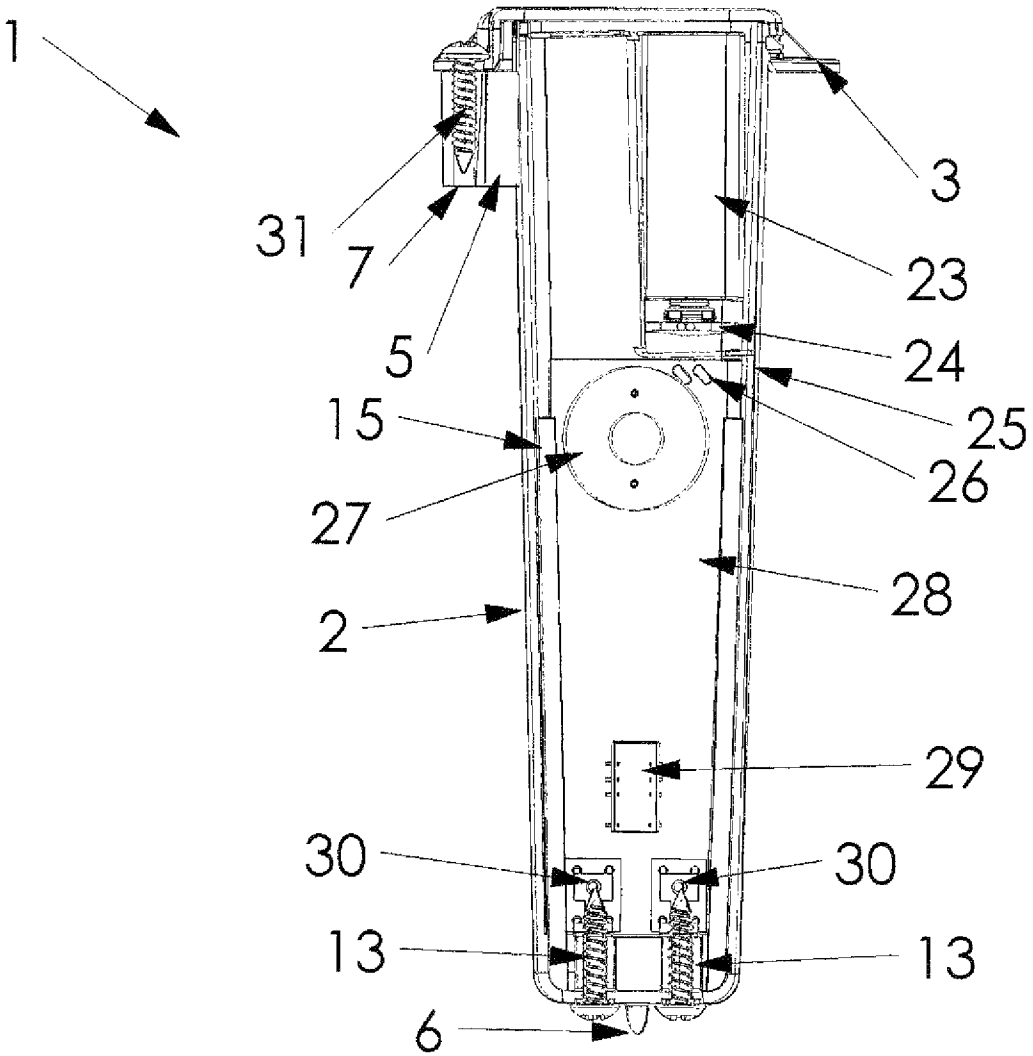
FIG. 9 is a section view of the alarm in FIG. 1 showing the alarm housing and its bottom standoff, cap, fastener securing alarm housing and cap together, internal alarm components, battery, and two water sensors electrically connected in their usable positions to the sensor contacts/mounts.
Figure 10:
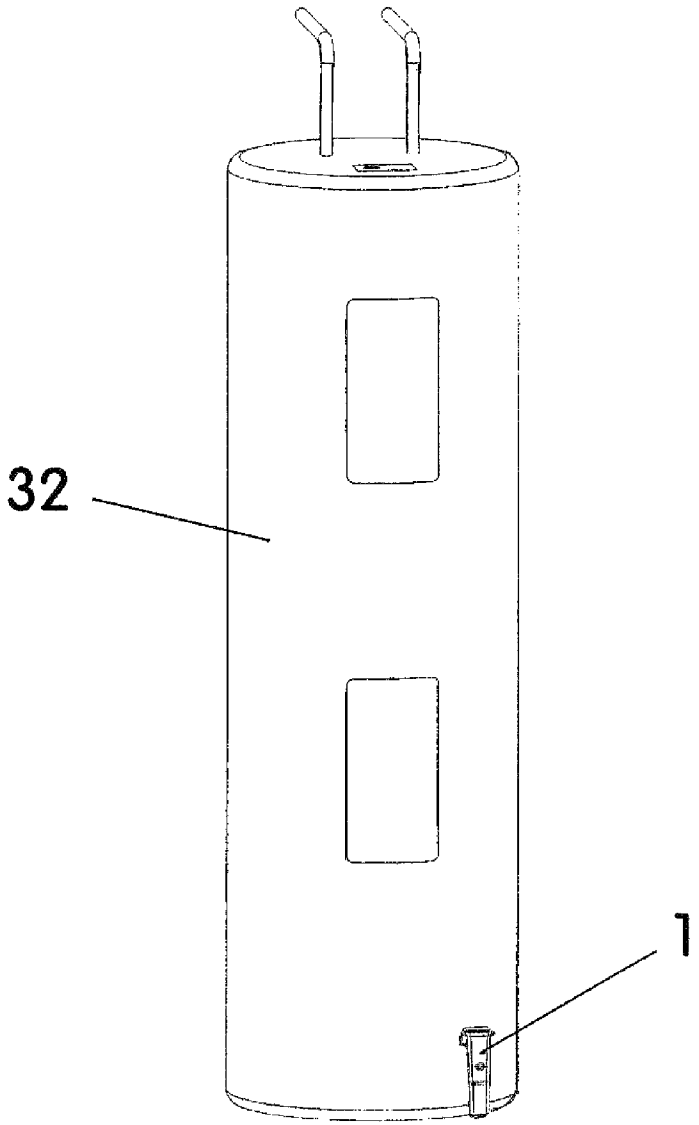
FIG. 10 is a perspective view from the front of the alarm shown in FIG. 1 secured against the exterior surface of a hot water heater tank, with the standoff of the alarm very close to, or touching, the floor or other surface supporting the water heater tank.

FIGS. 8 and 9 both show internal alarm components 22 preferably used as a part of the most preferred embodiment of the water heater alarm 1 shown in FIG. 1. FIG. 8 is a perspective view of internal alarm components 22, showing a battery 23 connected to a printed circuit board 28 via electrical connector 24 and electrical wiring 25. Also shown in FIG. 8 is wire strain relief 26 used to protect wiring 25 during replacement of battery 23. In addition, FIG. 8 shows a centrally-mounted annunciator 27 and an optional relay 29 connected to printed circuit board 28. Although not shown, an optional wireless out could also be a part of printed circuit board 28 for remote wireless owner notification of fluid leakage from an associated water heater tank 32. FIG. 8 further shows two sensor mounts 30 positioned adjacent to the lower end of alarm housing 2 for use in electrically connecting fluid sensors 13 to printed circuit board 28. When water is simultaneously in contact with both fluid sensors 13, an electrical circuit is completed, activating the annunciator 27 to begin owner notification alarming. A low voltage detection circuit is also preferred in the present invention alarm system 1 to minimize electrolysis, which degrades electrodes (fluid sensors 13 in FIGS. 1-10). In contrast, FIG. 9 shows the internal alarm components 22 secured within alarm housing 2, with printed circuit board 28 secured in a fixed position on both of its sides via integrated internal alarm housing 2 structure creating the opposed/paired slots 15 (also shown in FIG. 5). FIG. 9 also shows a fastener 31 secured within the vertically-extending cap mount opening 7 to secure cap 3 and alarm housing 2 to one another, and the two fluid sensors 13 with their distal ends situated against the external surface of alarm housing 2 and their proximal ends each in contact with a different electrical connector (contact/mount 30) secured to printed circuit board 28. Fluid sensors 13 utilize the conductivity of water to close the circuit between the two electrically connected contacts 30 during a fluid leaks from associated water heater tank 32. The static potential between these contacts 30 provides the needed excitation from the high side electrode to the low side electrode to activate a transistor (not shown) on printed circuit board 28 to interrupt the microcontroller (printed circuit board 28 in FIGS. 1-10) while it is in its sleep mode and conserving energy, to wake up and send an audible output burst. FIG. 9 also shows the standoff 6 that separates fluid sensors 13, optional relay 29, annunciator 27, battery 23, and the electrical connection (24, 25, and 26) between battery 23 and printed circuit board 28. FIG. 10 is a perspective view from the front of the most preferred embodiment of the alarm 1 shown in FIGS. 1-9 secured against the lower exterior surface of a hot water heater tank 32, with the standoff 6 of alarm 1 positioned very close to, or touching, the floor or other surface (not shown) supporting water heater tank 32. It is preferred for alarm system 1 to be 'in circuit programmable,' meaning that it is programmed after printed circuit board 28 is completely built. This allows rapid changes to software, when desired, without a change to current inventory or additional material expense. For purposes of alarm system 1, it is preferred for printed circuit board 28 to be programmed via a set of five contacts thereon which allows for a "bed of nails" test and programming fixture upon which to program the firmware. The software algorithm may be written in C code.

Figure 11:
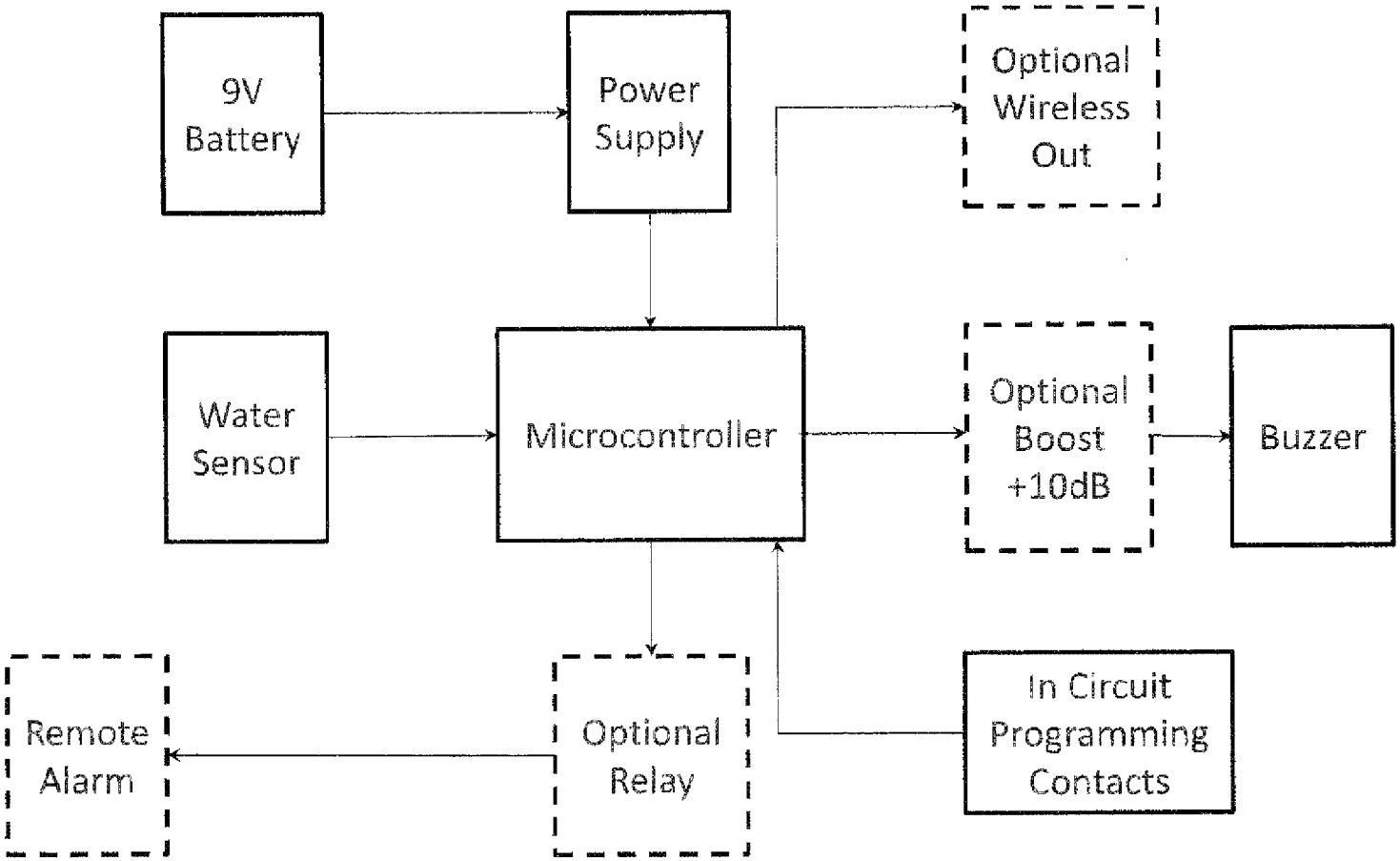
FIG. 11 is a block diagram of electrical communication between the internal alarm components in the hot water heater alarm shown in FIG. 1.

FIGS. 11-21 include flow charts, diagrams, graphs, and other information relating to the programming and operation of water sensor and alarm system 1. FIG. 11 is a block diagram of the electrical communication between the internal alarm components 22 in the hot water heater alarm 1 shown in FIG. 1. FIG. 11 shows a microcontroller (in the most preferred embodiment 1 shown in FIGS. 1-10 referred to as printed circuit board 28) receiving electrical communication/input from in circuit programming contacts (contacts 30 in FIGS. 1-10), a power supply having a 9-volt battery (battery 23 in FIGS. 1-10), and water sensors (fluid sensors 13 in FIGS. 1-10). Although not shown in the block diagram in FIG. 11, zero drop reverse polarity protection on the battery 23 input is preferred using a metal oxide semiconductor field effect transistor (MOSFET) instead of a diode. FIG. 11 also shows microcontroller (printed circuit board 28 in FIGS. 1-10) sending electrical communication/output to an optional relay (relay 29 in FIGS. 1-10), which is then forwarded to a remote alarm (not shown in FIGS. 1-10). FIG. 11 also shows microcontroller (printed circuit board 28 in FIGS. 1-10) sending electrical communication/output to an optional wireless out (not shown in FIGS. 1-10) and a buzzer (annunciator 27 in FIGS. 1-10) responsible for producing an audible alarm, with an optional boost and implementation using a DC/DC converter to amplify buzzer loudness by 10 decibels being shown in FIG. 11 situated between microcontroller (printed circuit board 28) and the buzzer (annunciator 27), the boost in buzzer (annunciator 27) loudness amplification being a tradeoff with conserving power. Although not shown, a switch to measure the voltage of battery 23 and a low power regulator are also used with the microcontroller (printed circuit board 28 in FIGS. 1-10) to achieve ultra low battery 23 power realization.

Figure 12:
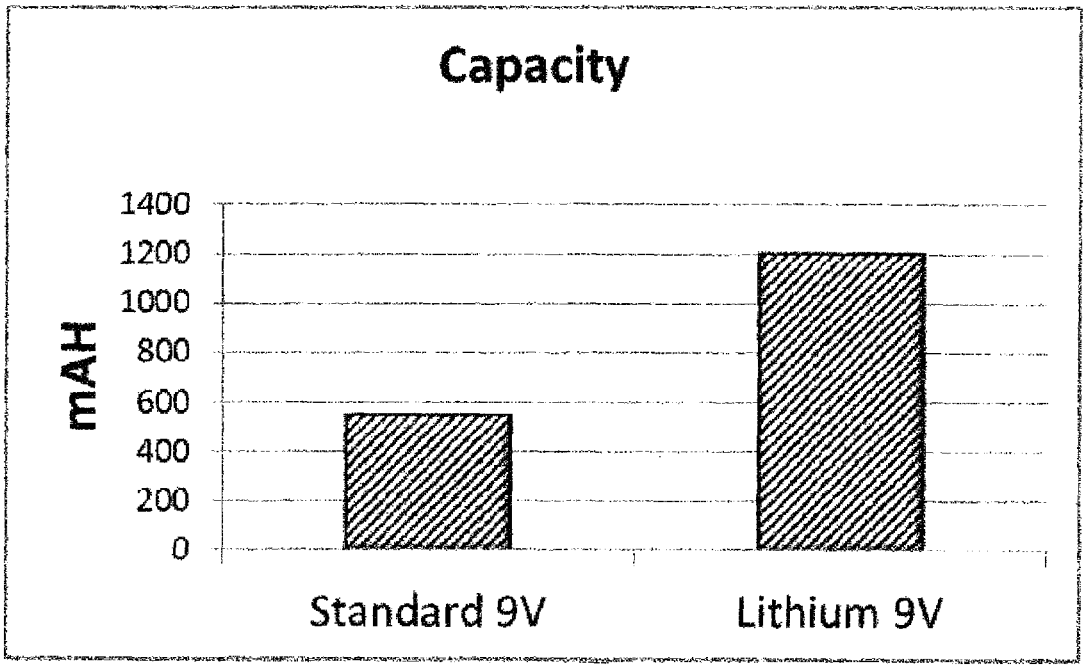
FIG. 12 is a graph comparing battery capacity as it preferably relates to the hot water heater alarm shown in FIG. 1.
Figure 13:
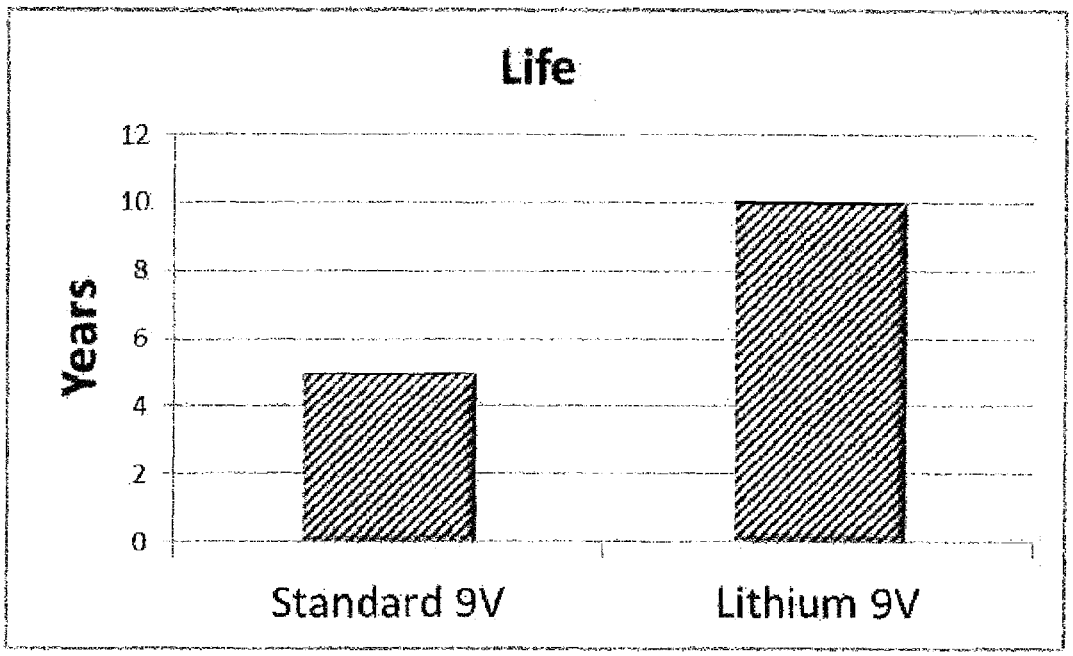
FIG. 13 is a graph comparing battery life as it preferably relates to the hot water heater alarm shown in FIG. 1.
Figure 14:
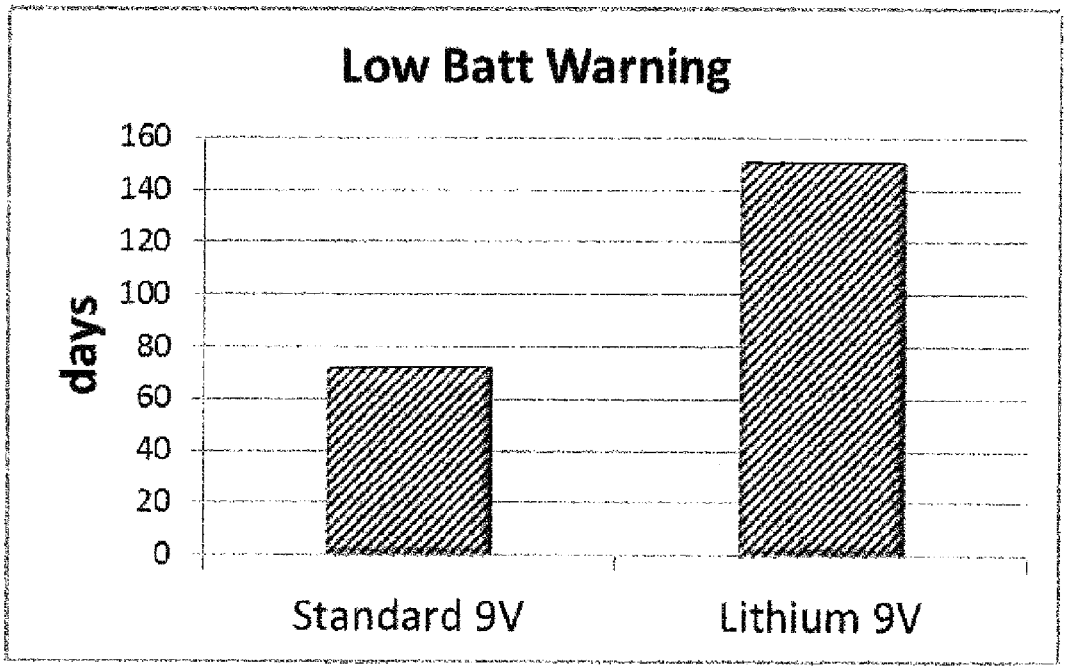
FIG. 14 is a graph comparing time periods of low battery warning as it preferably relates to the hot water heater alarm shown in FIG. 1.
Figure 15:
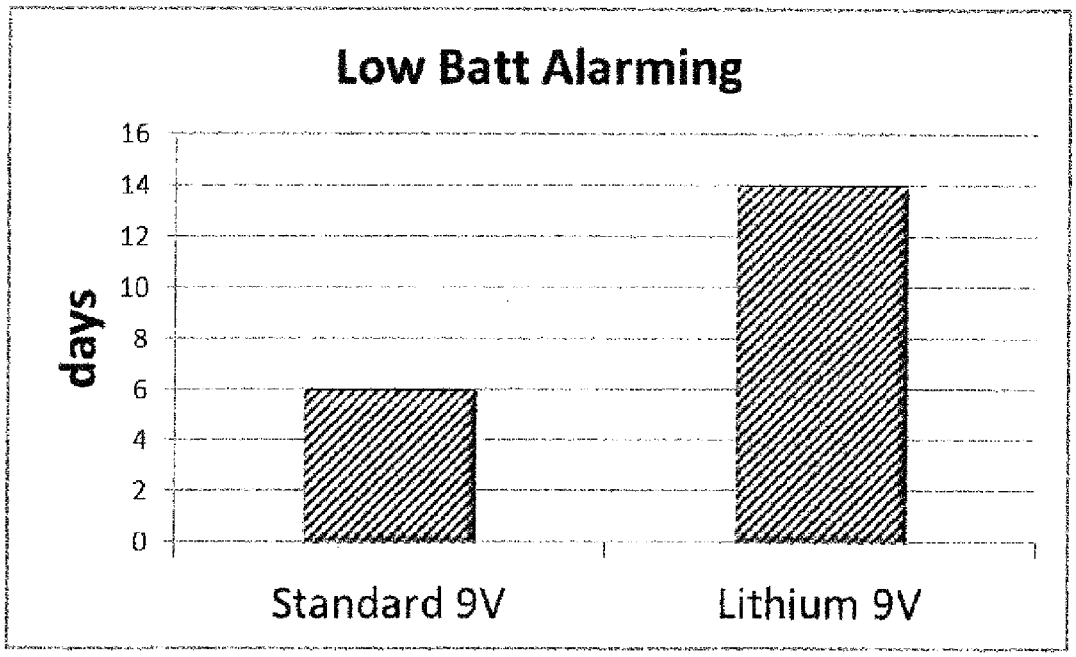
FIG. 15 is a graph comparing time periods of low battery alarming as it preferably relates to the hot water heater alarm shown in FIG. 1.

FIGS. 12-15 relate respectively to standard and lithium 9-volt options for power source (battery 23 in FIGS. 1-10), and respectively show approximate milliamp-hours of electrical charge capacity, approximate years of life, approximate days of low battery warning, and approximate days low battery alarming. FIG. 12 is a graph comparing power source (battery 23 in FIGS. 1-10) capacity as it relates to the alarm 1 shown in FIG. 1, and shows that if a standard 9-volt battery 23 is used with water sensor and alarm system 1, between 500 and 600 milliamp-hours of electrical charge would be available, while if instead a 9-volt Lithium battery 23 is used, it would provide more than double the milliamp-hours of electrical charge. In contrast, FIG. 13 is a graph comparing battery life as it relates to the alarm 1 shown in FIG. 1, and shows that if a standard 9-volt battery 23 is used with water sensor and alarm system 1, an approximate life of five years would be expected, while if instead a 9-volt Lithium battery 23 is used, an approximate life of ten years would be expected. FIGS. 14 and 15 each have a graph relating to power source (battery 23 in FIGS. 1-10) options for low battery owner notification. FIG. 14 compares expected time periods of low battery warning for standard 9-volt and lithium batteries 23 as it relates to the alarm 1 shown in FIG. 1, while the graph in FIG. 15 compares time periods of low battery alarming as it relates to the alarm 1 shown in FIG. 1 depending upon the use of a standard 9-volt battery 23 or a lithium battery 23. During use of a standard 9-volt battery 23, FIGS. 14 and 15 show an anticipated time period for low battery warning of approximately seventy days, followed by an anticipated time period for low battery alarming of approximately six days. In contrast, the use of a lithium 9-volt battery 23 more than doubles the anticipated time periods over the use of a 9-volt battery 23, with FIGS. 14 and 15 respectively showing an anticipated time period for low battery warning of approximately one-hundred-fifty days, followed by an anticipated time period for low battery alarming of approximately fourteen days.

Figure 16:
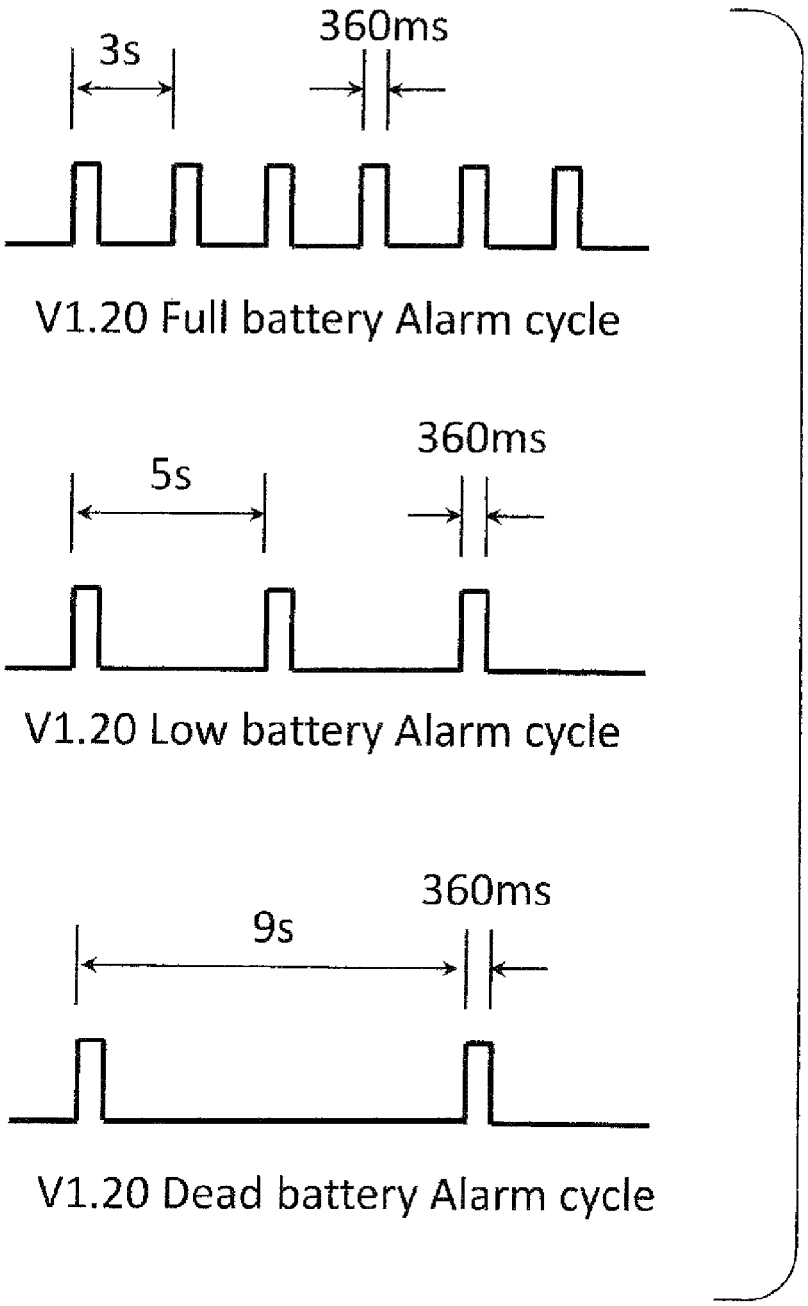
FIG. 16 is a series of three graphs comparing alarm cycle variance, with the top graph showing a full battery cycle wherein a notification signal is emitted every 3 seconds, the middle graph showing a low battery cycle during which power conservation starts to become an issue and causes a notification signal to be emitted every 5 seconds, and the bottom graph showing a dead battery cycle were voltage in the battery drops below 7.0 volts and increased power conservation occurs with a notification signal emitted every 9 seconds.

Furthermore, FIG. 16 is a series of three graphs comparing alarm cycle variance in alarm system 1 that helps it to achieve ultra low power consumption. The microprocessor (printed circuit board 28 in FIG. 1-10) periodically monitors the current voltage of the power source (battery 23 in FIGS. 1-10), in order to alert the owner when battery 23 is dying and in need of replacement. Ample time is given for the owner (not shown) to detect the low battery alarm, due to the possibility that the owner may be out-of-town when battery 23 first drops below the low battery voltage threshold. Furthermore, alarm system 1 will conserve energy as much as possible during the alarming phase by entering a sleep mode between audible output bursts. Again, the owner may not be home when a water leak from water heater tank 32 is first detected, and battery 23 must last long enough for the owner to detect the need for battery 23 replacement. It is a tradeoff and balance between annunciating often enough for proper owner notification and conserving battery 23 energy so that is will last long enough for the owner to have an opportunity to detect the alarm. The top graph in FIG. 16 identifies a preferred 360-millisecond duration of each audible output burst and the preferred 3-second spaced-apart timing of successive bursts when battery 23 has full power, defined as more than 8.0 volts. In contrast, the middle graph in FIG. 16 identifies a preferred 360-millisecond duration of each audible output burst and the preferred 5-second spaced-apart timing of successive bursts when battery 23 has low power, defined as less than 8.0 volts but more than 7.0 volts. The bottom graph in FIG. 16 identifies a preferred 360-millisecond duration of each audible output burst and the preferred 9-second spaced-apart timing of successive bursts when the energy of battery 23 is nearly spent, also referred to as a dead battery cycle, defined as less than 7.0 volts. Since 99.9% of the life battery 23 is expected to be when it has more than 8.0-volts, monitoring the voltage of battery 23 every 12-hours is an acceptable time period of time toward a goal of power conservation and potentially will allow monitoring of a hot water heater tank 32 for fluid leaks during a minimum time period of five to ten years, depending upon the type of battery 23 used. When battery 23 starts dying, monitoring and warning/alarming times occur more often in an attempt to capture the owner's attention.

Figure 17:
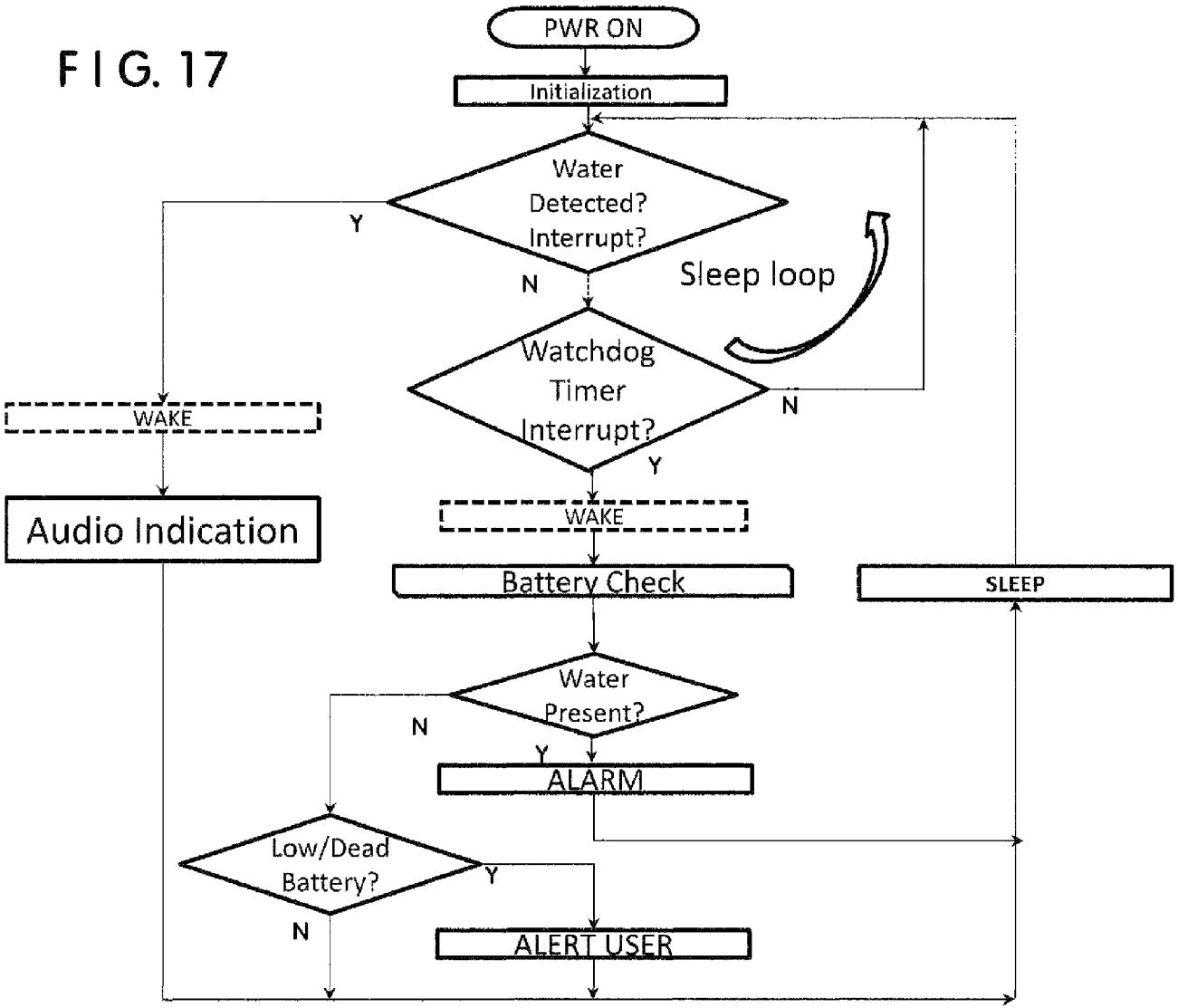
FIG. 17 is a software flowchart identifying steps used to achieve ultra low power conservation in the most preferred embodiment of the present invention, which starts with the step of Power On, continues through a Sleep mode step, and then proceeds with steps of monitoring water leakage from an associated water heater tank and current battery charge.
Figure 19:
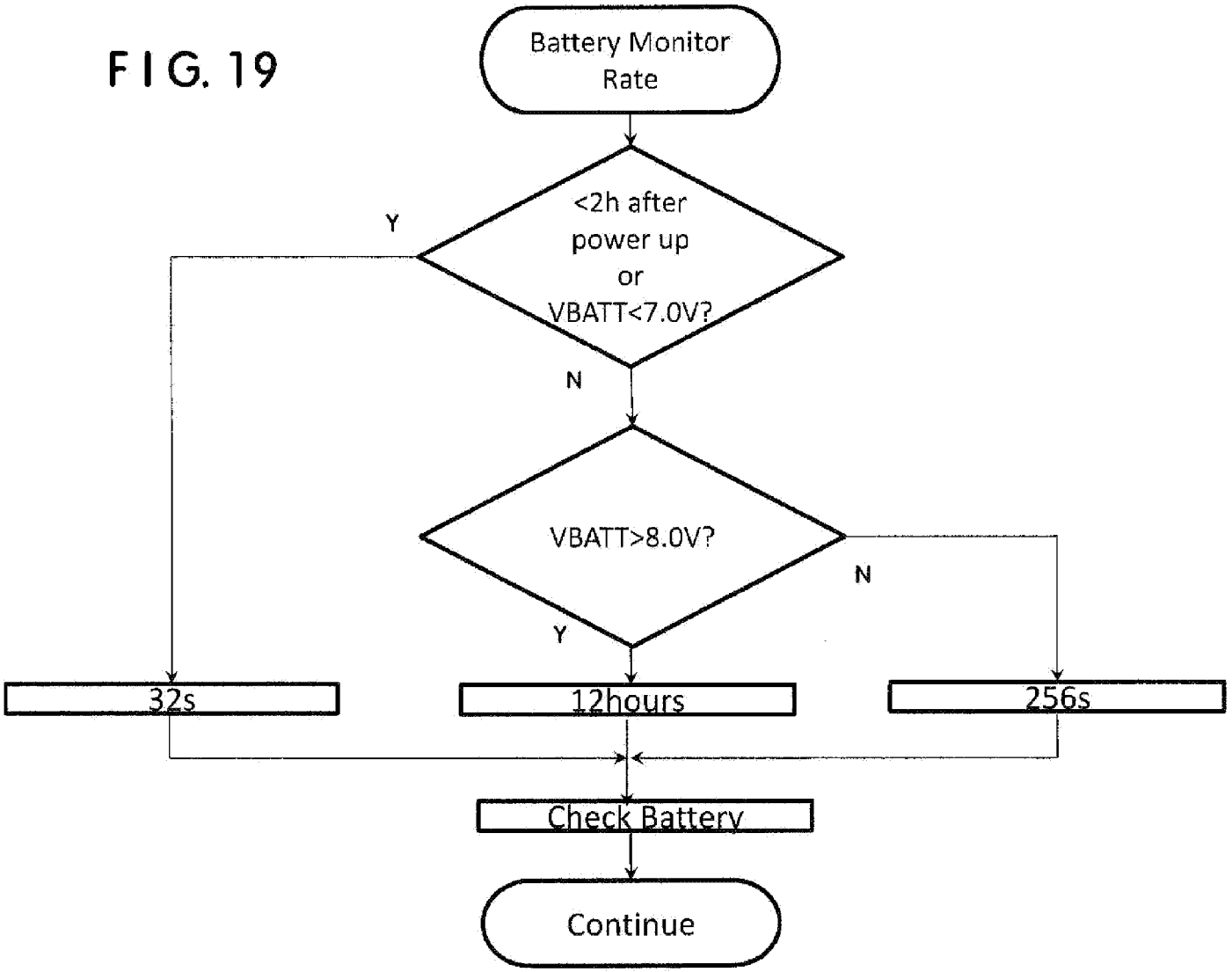
FIG. 19 is a software flowchart further identifying the preferred monitoring choices for the Check Battery step included in the flowchart of FIG. 17.
Figure 20:
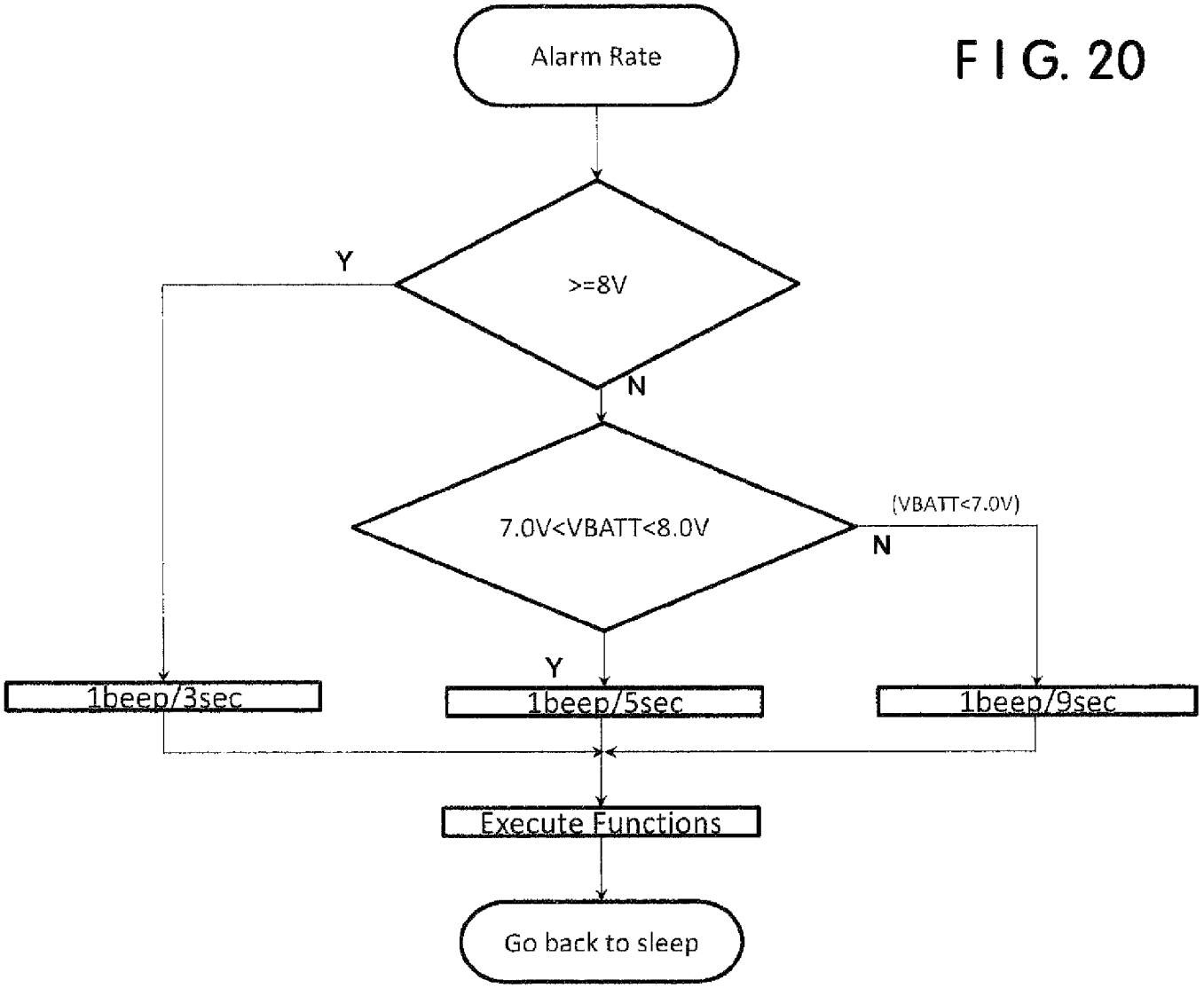
FIG. 20 is a software flowchart further identifying the preferred choices for the Alarm step included in the flowchart of FIG. 17.
Figure 21:
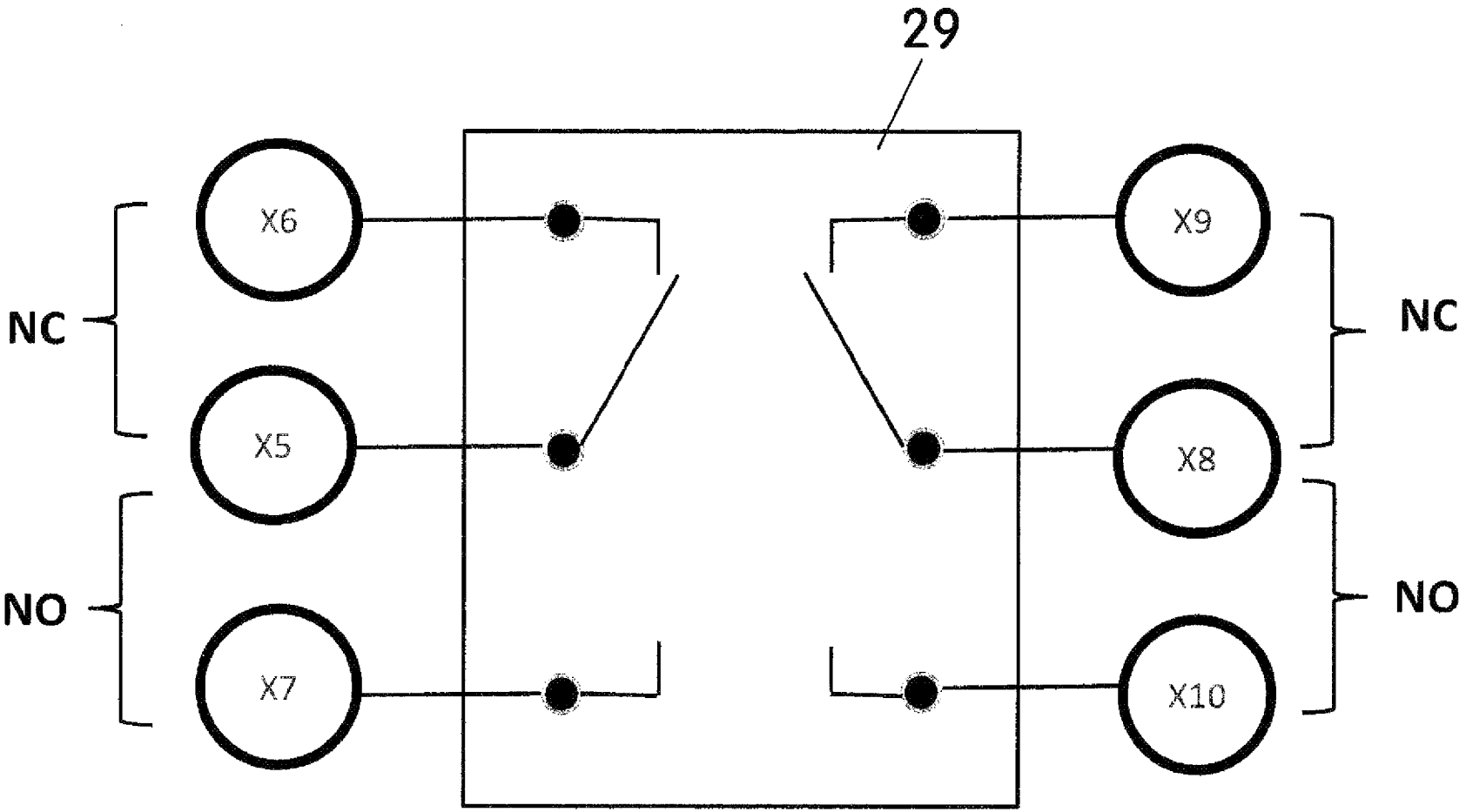
FIG. 21 is a relay wiring diagram usable with the alarm shown in FIG. 1.

FIGS. 17-20 provide software flowcharts relating to the ultra low power consumption during the operation of water sensor and alarm system 1, and FIG. 21 provides a preferred wiring diagram for the relay 29 shown in FIGS. 8 and 9. FIG. 17 is a software flowchart from the step of Power On, continues through a Sleep mode step, and then proceeds with steps of monitoring water leakage from an associated water heater tank 32 and current battery 23 charge. The first step shown in FIG. 17 is "PWR ON", indicating that battery 23 has been connected. The second step after "PWR ON" in FIG. 17 is "Initialization", which could involve new changes to software, waking alarm system 1, and/or user testing to make certain that alarm system 1 is fully operational and annunciator 27 will produce an audible output burst when the presence of fluid (not shown) causes an electrical connection is made between fluid sensors 13. Test operation of annunciator 27 for confidence of its proper function can at any time be easily accomplished by a user simultaneously touching both of the bottom exposed fluid sensors 13 with wet fingers. The third step of the flowchart shown in FIG. 17 is diamond-shaped, indicating that it involves a YES/NO decision. If water adjacent to water heater 32 is not detected by fluid sensors 13, the operation of alarm system 1 continues in a downwardly direction to a second diamond-shaped step (fourth step), which evaluates whether additional steps need to be taken, or whether a sleep loop begins. If the watchdog timer in the microprocessor (printed circuit board 28 in FIGS. 1-10) does not indicate that sufficient time has passed to require a check of the remaining voltage in battery 23, then a sleep loop begins. If the answer to the YES/NO decision in the diamond-shaped third step was YES (indicated by the letter Y to the left of diamond-shape), the downward operational path on the left side of FIG. 17 is taken, first involving the waking of alarm system 1 and a second step of Audio Indication wherein annunciator 27 produces an audible output burst of a predetermined duration and loudness. When the audible output burst from annunciator 27 is complete, alarm system 1 enters a Sleep mode, and if sufficient voltage remains in battery 23 and a predetermined time elapses, the microprocessor (printed circuit board 28 in FIGS. 1-10) in alarm system 1 will begin again at the third step and determine if water adjacent to water heater 32 is detected by fluid sensors 13, and then repeat the steps following the third step according to the YES/NO decision reached at that time. Going back to the diamond-shaped fourth step, if instead of a NO decision, there is a YES decision that sufficient time has passed to require a check of the remaining voltage in battery 23, then operation of alarm system 1 continues in a downwardly direction, first involving the waking of alarm system 1 and then a sixth step of checking the remaining voltage of battery 23. Following the check of voltage in battery 23, the microprocessor (printed circuit board 28 in FIGS. 1-10) in alarm system 1 reaches the seventh step involving a decision whether water adjacent to water heater tank 32 is detected by fluid sensors 13. If the answer is YES (indicated by the letter Y below the diamond-shape), annunciator 27 produces an audible output burst of a predetermined duration and loudness. When the audible output burst from annunciator 27 is complete, alarm system 1 enters a Sleep mode, and if sufficient voltage remains in battery 23 and a predetermined time elapses, the microprocessor (printed circuit board 28 in FIGS. 1-10) in alarm system 1 will begin again at the third step and determine if water adjacent to water heater 32 is detected by fluid sensors 13, and then repeat the steps following the third step according to the YES/NO decision reached at that time. Going back to the seventh step, if the answer is NO (indicated by the letter N to the left of the diamond-shape), microprocessor (printed circuit board 28 in FIGS. 1-10) in alarm system 1 will arrive at the fourth diamond-shaped step of the flowchart in FIG. 17, and again check the remaining voltage in battery 23. If a NO decision is reached and the voltage of battery 23 is greater than 8.0 volts, alarm system 1 enters a Sleep mode, and after a predetermined amount of time elapses the microprocessor (printed circuit board 28 in FIGS. 1-10) in alarm system 1 will begin again at the third step and determine if water adjacent to water heater 32 is detected by fluid sensors 13, and then repeat the steps following the third step according to the YES/NO decision reached at that time. If at the juncture of the fourth diamond-shaped step of the flowchart in FIG. 17 a YES decision is reached and the voltage of battery 23 is not greater than 8.0 volts, the microprocessor (printed circuit board 28 in FIGS. 1-10) in alarm system 1 will initiate an ALERT USER step, causing annunciator 27 to create a low battery warning or dead battery alarming for owner notification depending upon the amount of voltage actually detected in battery 23. When the warning or alarming is complete, alarm system 1 enters a Sleep mode, and if sufficient voltage remains in battery 23 and a predetermined time elapses, the microprocessor (printed circuit board 28 in FIGS. 1-10) in alarm system 1 will begin again at the third step and determine if water adjacent to water heater 32 is detected by fluid sensors 13, and then repeat the steps following the third step according to the YES/NO decision reached at that time.

Figure 18:
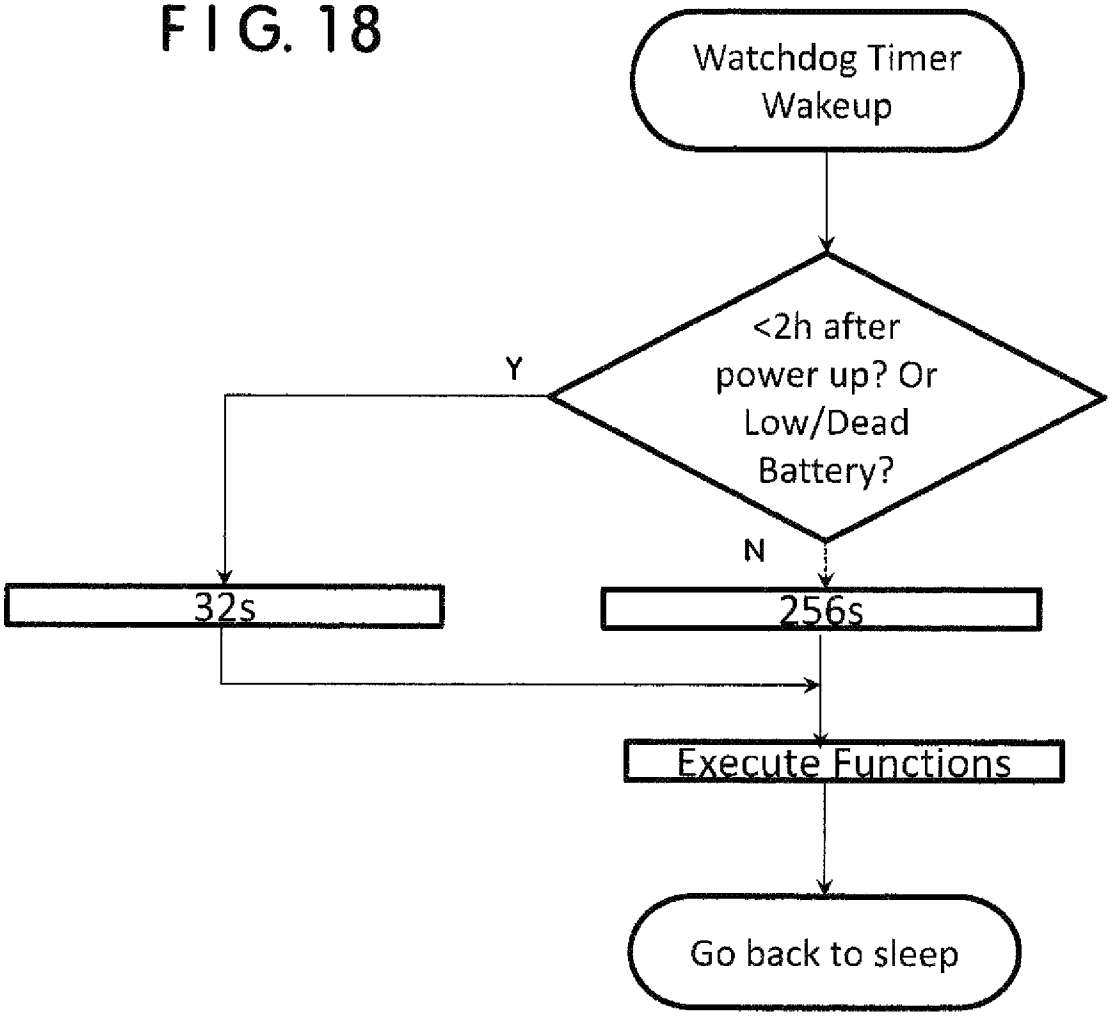
FIG. 18 is a software flowchart further interpreting the step of Watchdog Timer Wakeup included in the flowchart of FIG. 17.

FIG. 18 is a software flowchart further interpreting the step of Watchdog Timer Wakeup included in the flowchart of FIG. 17. Additionally, FIG. 19 is a software flowchart further identifying the preferred monitoring choices for the Check Battery step included in the flowchart of FIG. 17, and FIG. 20 is a software flowchart further identifying the preferred choices for the Alarm step included in the flowchart of FIG. 17. FIG. 18 shows that the watchdog timer in FIG. 17 preferably uses a minimum time period of 2-hours after power up, or a determination of low/dead battery 23 (voltage respectively below 8.0/7.0 volts), to decide whether it will wake up the microprocessor (printed circuit board 28 in FIGS. 1-10) for execution of needed functions, including a check of remaining battery voltage, a determination of whether fluid sensors 13 detect the presence of water, owner notification of low battery voltage below 8.0-volts, owner notification of dead battery status with voltage of battery 23 below 7.0-volts and owner notification that fluid sensors 13 have detected the presence of water. If the determination is YES (the 2-hour minimum time period after power up has not been exceeded or the battery voltage is less than 8.0 volts), the watchdog timer wakeup circuit in alarm system 1 will waken the microprocessor (printed circuit board 28 in FIGS. 1-10) every 32 seconds to execute needed functions, after which it will allow the microprocessor to go back to sleep. If the determination is NO (the 2-hour minimum time period has been exceeded and the battery voltage is greater than 8.0 volts), the watchdog timer wakeup circuit in alarm system 1 will waken the microprocessor (printed circuit board 28 in FIGS. 1-10) after a delay of 256 seconds (a little over four minutes) to execute needed functions (checking whether fluid sensors 13 detect the presence of water, checking again whether the remaining voltage of battery 23 exceeds 7.0 or 8.0 volts and if this subsequent voltage check is YES providing appropriate owner warning or alarming), after which it will allow the microprocessor (printed circuit board 28 in FIGS. 1-10) to go back to sleep.

Similarly, FIG. 19 shows that the watchdog timer in FIG. 17 preferably uses a minimum time period of 2-hours after power up, or a determination of whether the voltage in battery 23 is above or below 7.0 volts to initially determine whether to wake the microprocessor (printed circuit board 28 in FIGS. 1-10). If the determination is NO (the 2-hour minimum time period is less than 2 hours and the remaining voltage in battery 23 is greater than 7.0 volts), another determination is made, whether the voltage in battery 23 is greater than 8.0 volts. In the time period less that two hours after power up or if battery 23 has a voltage less than 7.0 volts, a battery monitoring check is made every 32 seconds. In the alternative, if battery 23 has a voltage less than 8.0 volts but greater than 7.0 volts, battery monitoring checks are made every 256 seconds (a little over four minutes). In the alternative, when battery 23 has a voltage greater than 8.0 volts, battery monitoring checks are made every twelve hours, conserving power.

In contrast, FIG. 20 is a software flowchart that further identifies the preferred choices for the frequency of the audible output bursts from annunciator 27 used in the Alarm step included in the flowchart of FIG. 17. If the voltage in battery 23 is greater than 8.0 volts, the audible output bursts of annunciator 27 will be at a rate of 1 beep-per-3-seconds, after which the microprocessor of alarm system 1 will execute needed functions, and then it will be allowed to go back to sleep. In the alternative, if the voltage in battery 23 is less than 8.0 volts but greater than 7.0 volts, the audible output bursts of annunciator 27 will be at a rate of 1 beep-per-5-seconds, after which the microprocessor of alarm system 1 will execute needed functions, and then it will be allowed to go back to sleep. As a third option, if the voltage in battery 23 is less than 7.0 volts, the audible output bursts of annunciator 27 will be at a power conserving rate of 1 beep-per-9-seconds, after which the microprocessor of alarm system 1 will execute needed functions, and then it will be allowed to go back to sleep. FIG. 16 also identifies these same preferred rates of audible output bursts from annunciator 27, and also identifies preferred audible output burst durations of approximately 360 milliseconds. The wiring diagram in FIG. 21 shows the preferred wiring of the relay 29 shown FIGS. 8 and 9, wherein some electrical connections are normally open (marked with the designation NO), and others are normally closed (marked with the designation NC). The optional relay 29 activation of a home security system or external warning system (not shown) allows for the possibility of prompt home owner notification about a water leak from the associated water heater tank 32, with such notification possible via SMS text messaging, phone call, email, and the like.

While the written description of the present invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited to the above-described embodiments, methods, and examples, but instead encompassing all embodiments and methods within the scope and spirit of the invention as defined in the appended claims.

We claim:

1. A water sensor and alarm system for storage hot water heaters comprising:

an alarm housing having a rear surface, a top open end, a front audible alarm opening, and two bottom holes separated by a standoff;

a cap connected to said alarm housing and covering said top open end;

a printed circuit board positioned within said alarm housing;

an annunciator electrically connected to said printed circuit board and able to produce an audible signal, said annunciator positioned near said front audible alarm opening;

two electrical contacts electrically connected to said printed circuit board near said two bottom holes;

a source of electrical power electrically connected to said printed circuit board; and two fluid sensors each extending through a different one of said two bottom holes in said alarm housing and electrically connected to a different one of said electrical contacts, wherein when said alarm housing is attached to a hot water heater tank with said standoff adjacent to the surface supporting the hot water heater tank, and further when fluid leaking from the hot water heater tank contacts both of said fluid sensors, an electrical circuit is completed that activates said annunciator to provide audible notification that a leak has occurred.

2. The system of claim 1 further comprising a relay connected to said printed circuit board, providing fluid leak communication to remotely located signal receiving devices for owner notification.

3. The system of claim 2 further comprising a wireless out connected to said printed circuit board and wherein said fluid leak communication is selected from a group consisting of an audible signal originated by said annunciator, a signal sent electrically to a remote location, a wireless signal, and a signal transmitted through a home security device to a 24-hour security monitoring network.

4. The system of claim 1 wherein said annunciator further comprises boost means adapted for creating an increase in annunciator loudness.

5. The system of claim 4 wherein said increase in annunciator loudness at a minimum is approximately 10 dB.

6. The system of claim 1 wherein said source of electrical power is a 9-volt battery.

7. The system of claim 1 wherein said alarm housing further comprises at least one projection near said top open end configured for engagement with said cap, promoting a secure connection between said alarm housing and said cap.

8. The system of claim 1 wherein said alarm housing and said cap are connected together via a cap mount and fastener.

9. The system of claim 1 wherein said alarm housing further comprises opposed interior slots receiving and maintaining fixed positioning of said printed circuit board.

10. The system of claim 1 further comprising one portion of a hook-and-loop fastener associated with said rear surface of said alarm housing, wherein when a mating portion of said hook-and-loop fastener is associated with a hot water heater tank, said alarm housing can be installed promptly against the hot water heater for leak monitoring.

11. The system of claim 1 wherein said source of electrical power electrically connected to said printed circuit board further comprises strain relief.

12. The system of claim 1 wherein said printed circuit board has in circuit programming and is programmed with a sleep mode of varying durations depending upon the amount of voltage remaining in said source of electrical power.

13. The system of claim 1 wherein upon leak detection by said sensors said printed circuit board is programmed with an alarming capability that causes audible notification from said annunciator approximately once every three seconds when said source of electrical power has more than 8.0 volts, approximately once every five seconds when said source of electrical power has less that 8.0 volts but more than 7.0 volts, and approximately once every nine seconds when said source of electrical power has less than 7.0 volts of remaining electrical charge.

14. The system of claim 1 wherein said printed circuit board is programmed with battery monitoring capability that causes monitoring of said source of electrical power for remaining voltage approximately once every thirty two seconds within an approximate two hour period after said source of electrical power is activated, approximately once every thirty two seconds when said source of electrical power has less than 7.0 volts, approximately once every twelve hours if more than approximately two hours has passed after said source of electrical power is activated and when said source of electrical power has more than 8.0 volts, and approximately once every two hundred fifty six seconds when said source of electrical power has more than 7.0 volts but less than 8.0 volts.

15. The system of claim 1 wherein said printed circuit board is programmed with timer wakeup capability that causes the end of said sleep mode approximately once every thirty two seconds within an approximate two hour period after said source of electrical power is activated, approximately once every two hundred fifty six seconds when more than two hours has passed after said source of electrical power is activated, and approximately once every thirty two seconds when said source of electrical power has less than 7.0 volts.

16. The system of claim 1 wherein said printed circuit board is programmed for monitoring water leaks, warning notification of low battery power, and low battery alarming for a minimum period of approximately five years.

17. The system of claim 16 wherein said printed circuit board is programmed for said warning notification of low battery power for a minimum period of approximately sixty days and said low battery alarming for a minimum period of approximately five days.

18. The system of claim 1 further comprising:

a relay connected to said printed circuit board, providing fluid leak communication to remotely located signal receiving devices for owner notification;

a wireless out connected to said printed circuit board and wherein said fluid leak communication is selected from a group consisting of an audible signal originated by said annunciator, a signal sent electrically to a remote location, a wireless signal, and a signal transmitted through a home security device to a 24-hour security monitoring network;

said annunciator having boost means adapted for creating an increase in annunciator loudness;

said printed circuit board having in circuit programming; and said printed circuit board programmed with a sleep mode of varying durations depending upon the amount of voltage remaining in said source of electrical power.

19. The system of claim 18 wherein said printed circuit board is programmed for monitoring water leaks, warning notification of low battery power, and low battery alarming for a minimum period of approximately five years, with said warning notification occurring for a minimum period of approximately sixty days, and said low battery alarming occurring for a minimum period of approximately five days.

20. A method of using the system of claim 1 comprising a step of providing a hand with at least two wet fingers, and a step of testing proper operation of said annunciator to produce said audible notification by placing a different one of said wet fingers in contact with the portion of each of said sensors exposed through said bottom holes in said alarm housing, with said annunciator producing said audible notification providing confirmation of said proper operation.

* * * * *